US010268131B2

(12) United States Patent
Shitara et al.

(10) Patent No.: US 10,268,131 B2
(45) Date of Patent: Apr. 23, 2019

(54) CLEANER FOR CLEANING DROPLET EJECTOR, AND PARTICULATE MATERIAL PRODUCTION APPARATUS USING THE CLEANER

(71) Applicant: RICOH COMPANY, LTD., Tokyo (JP)

(72) Inventors: Yasutada Shitara, Shizuoka (JP); Minoru Masuda, Shizuoka (JP); Shinji Aoki, Shizuoka (JP); Yoshihiro Norikane, Kanagawa (JP); Andrew Mwaniki Mulwa, Kanagawa (JP); Masaru Ohgaki, Shizuoka (JP); Kiyotada Katoh, Shizuoka (JP); Satoshi Takahashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 183 days.

(21) Appl. No.: 15/344,928

(22) Filed: Nov. 7, 2016

(65) Prior Publication Data

US 2017/0050204 A1 Feb. 23, 2017

Related U.S. Application Data

(62) Division of application No. 14/029,954, filed on Sep. 18, 2013, now Pat. No. 9,539,600.

(30) Foreign Application Priority Data

| | | |
|---|---|---|
| Sep. 18, 2012 | (JP) | 2012-204515 |
| Jun. 26, 2013 | (JP) | 2013-134148 |
| Aug. 21, 2013 | (JP) | 2013-171571 |

(51) Int. Cl.
*G03G 9/13* (2006.01)
*B41J 2/165* (2006.01)
(Continued)

(52) U.S. Cl.
CPC ..... *G03G 9/132* (2013.01); *B05B 15/55* (2018.02); *B05B 15/555* (2018.02);
(Continued)

(58) Field of Classification Search
None
See application file for complete search history.

(56) References Cited

U.S. PATENT DOCUMENTS

| | | | |
|---|---|---|---|
| 6,350,007 | B1 | 2/2002 | Meichle et al. |
| 2008/0063971 | A1 | 3/2008 | Watanabe et al. |

(Continued)

FOREIGN PATENT DOCUMENTS

| | | |
|---|---|---|
| EP | 0995606 A2 | 4/2000 |
| JP | 2000-117996 | 4/2000 |

(Continued)

OTHER PUBLICATIONS

Japanese official action dated Mar. 24, 2017 in corresponding Japanese Patent Application No. 2013-171571.

(Continued)

*Primary Examiner* — Eric W Golightly
(74) *Attorney, Agent, or Firm* — Cooper & Dunham LLP

(57) ABSTRACT

A cleaner, such as provided in a particulate material production apparatus, for cleaning a droplet ejector, which includes nozzles to eject a particulate material composition liquid as droplets, and a nozzle plate bearing the nozzles. A substantially closed cleaning space is formed outside the nozzles and the nozzle plate, and a first cleaning liquid supplying device supplies a first cleaning liquid to the cleaning space so that the nozzles and the nozzle plate are contacted with the first cleaning liquid. In addition, a vibrator vibrates the first cleaning liquid when the nozzles and the nozzle plate are contacted with the first cleaning liquid to clean the nozzles and the nozzle plate.

7 Claims, 15 Drawing Sheets

(51) Int. Cl.

| | |
|---|---|
| ***G03G 9/12*** | (2006.01) |
| ***B05B 15/55*** | (2018.01) |
| ***B05B 15/555*** | (2018.01) |

(52) U.S. Cl.

CPC ..... *B41J 2/1652* (2013.01); *B41J 2/16552* (2013.01); *G03G 9/122* (2013.01)

(56) References Cited

U.S. PATENT DOCUMENTS

| | | | |
|---|---|---|---|
| 2008/0286680 | A1 | 11/2008 | Norikane et al. |
| 2009/0117486 | A1 | 5/2009 | Watanabe et al. |
| 2009/0170018 | A1 | 7/2009 | Kuramoto et al. |
| 2009/0239170 | A1 | 9/2009 | Honda et al. |
| 2009/0325100 | A1 | 12/2009 | Watanabe et al. |
| 2010/0003613 | A1 | 1/2010 | Honda et al. |
| 2010/0021209 | A1 | 1/2010 | Watanabe et al. |
| 2010/0227267 | A1 | 9/2010 | Shitara et al. |
| 2010/0231634 | A1 | 9/2010 | Yokota et al. |
| 2011/0007116 | A1 | 1/2011 | Ohgaki |
| 2011/0014565 | A1 | 1/2011 | Norikane et al. |
| 2011/0050794 | A1 | 3/2011 | Koike et al. |
| 2011/0305987 | A1 | 12/2011 | Yohichiroh et al. |
| 2012/0070777 | A1 | 3/2012 | Makabe et al. |
| 2012/0094231 | A1 | 4/2012 | Norikane et al. |
| 2012/0264049 | A1 | 10/2012 | Masuda et al. |
| 2012/0270147 | A1 | 10/2012 | Katoh et al. |
| 2012/0270148 | A1 | 10/2012 | Norikane et al. |
| 2013/0010035 | A1 | 1/2013 | Norikane et al. |
| 2013/0034810 | A1 | 2/2013 | Norikane et al. |
| 2013/0069262 | A1 | 3/2013 | Mulwa et al. |

FOREIGN PATENT DOCUMENTS

| | | |
|---|---|---|
| JP | 2002-127439 | 5/2002 |
| JP | 2006-347000 | 12/2006 |
| JP | 2008-286947 | 11/2008 |
| JP | 2010-107904 | 5/2010 |
| JP | 2011-059567 | 3/2011 |
| JP | 2011-059832 | 3/2011 |
| JP | 2011-092841 | 5/2011 |
| JP | 2011-197161 | 10/2011 |
| JP | 2011-212668 | 10/2011 |
| JP | 2012-76261 | 4/2012 |
| JP | 2012-179811 | 9/2012 |
| JP | 2012-185411 | 9/2012 |

OTHER PUBLICATIONS

European Search Report dated Jan. 21, 2014 in corresponding European patent application No. 1318 41 41.3.

CLEANER FOR CLEANING DROPLET EJECTOR, AND PARTICULATE MATERIAL PRODUCTION APPARATUS USING THE CLEANER

CROSS-REFERENCE TO THE RELATED APPLICATIONS

The patent application is a divisional of application Ser. No. 14/029,954 filed Sept. 18, 2016 (now U.S. Pat. No. 9,539,600, issued Jan. 10, 2017) which is based on and claims priority pursuant to 35 U.S.C. § 119 to Japanese Patent Application Nos. 2012-204515, 2013 -134148 and 2013 -171571, filed on Sep. 18, 2012, Jun. 26, 2013, and Aug. 21, 2013, respectively, in the Japan Patent Office, the entire disclosure of which is hereby incorporated by reference herein.

TECHNICAL FIELD

This disclosure relates to a method for cleaning a droplet ejector having droplet ejecting nozzles. In addition, this disclosure relates to a cleaner to clean a droplet ejector. Further this disclosure relates to a particulate material production apparatus using the cleaner.

BACKGROUND

Uniformly-shaped particulate resins can be used for various purposes such as electrophotographic toners, spacers for use in liquid crystal panels, colored particles for use in electronic papers, and carriers for use in medicines. Specific examples of the method for producing such uniformly-shaped particulate resins include methods in which a uniformly-shaped particulate resin is produced by making a reaction in a liquid, such as soap-free polymerization methods. Soap-free polymerization methods have advantages such that a particulate resin having a relatively small particle diameter and a sharp particle diameter distribution can be produced; and the particle form is nearly spherical, but have problems to be solved such that a long time, and large amounts of water and energy are used for producing a particulate material because it takes time to perform such a polymerization reaction, it takes time to remove a solvent (typically water) from the liquid in which the reaction is performed, resulting in deterioration of production efficiency, and various processes such as a process for separating the resultant particulate material, and processes for washing and drying the particulate material after producing the particulate material in the liquid have to be performed.

In attempting to solve the problems mentioned above, some of the present inventors and other inventors have proposed toner production methods using an ejection granulation method in JP-2008-286947-A and JP-2011-197161-A. Specifically, the toner production methods use a droplet ejector for ejecting droplets of a toner composition liquid, which is a raw material of a toner. The droplet ejector has a thin film, which has multiple nozzles and which is periodically vibrated up and down by an electromechanical converter serving as a vibrator to periodically change the pressure in a chamber, which contains the toner composition liquid and which includes the thin film having the Multiple nozzles as a constitutional member, thereby ejecting droplets of the toner composition liquid from the nozzles to a space present below the nozzles. The thus ejected droplets of the toner composition liquid naturally fall through the space and proceed in the same direction, thereby forming lines of droplets of the toner composition liquid. In this regard, the ejected droplets are reshaped so as to be spherical due to the difference in surface tension between the toner composition liquid and air in the space. The reshaped droplets are then dried, resulting in formation of a particulate toner.

In addition, JP-2011-197161-A also discloses a method for cleaning the nozzle surface to which the toner composition liquid is adhered. The cleaning method uses a cleaning liquid ejector which is arranged so as to be opposed to the nozzle surface and which ejects a cleaning liquid toward the nozzle surface to clean the nozzle surface.

In the toner production methods mentioned above, there is a case where the toner composition liquid exudes from the nozzles, and therefore the toner composition liquid is adhered to the nozzle surface, or a case where the ejected droplets of the toner composition liquid fly back to the nozzle surface. The toner composition liquid thus adhered to the nozzle surface is solidified with time, and in addition the toner composition liquid is further adhered to the solidified toner composition, resulting in enlargement of the toner composition block on the nozzle surface (i.e., smudges are formed on the nozzle surface). In this case, there is a possibility that air turbulence is formed in the space located below the nozzles due to the toner composition block, thereby uniting droplets of the toner composition liquid ejected by the nozzles, resulting in broadening of the particle diameter distribution of the resultant toner and deterioration of productivity of the toner. Therefore, it is preferable to periodically clean the nozzle surface.

When smudges formed on the nozzle surface are removed by the cleaning method disclosed in JP-2011-197161-A, in which a cleaning liquid is sprayed to the nozzle surface, it takes time until the smudges are softened by the cleaning liquid. Alternatively, when the cleaning operation is repeated several times to soften the smudges, the cleaning time is relatively long. In addition, when a cleaning liquid is sprayed and the cleaning liquid is adhered to smudges, part of the cleaning liquid adhered to the toner composition block drips from the block, and therefore it is hard to sufficiently clean the nozzle surface. This problem is not limited to the toner production apparatus, and occurs in inkjet recording apparatus. Specifically, in inkjet recording apparatus, droplets of an inkjet ink are ejected from nozzles so that the droplets are adhered to a recording medium, resulting in formation of an image on the recording medium. In such inkjet recording apparatus, the ink is often adhered to the nozzle surface and then dried, thereby forming an ink deposit around the nozzles. When a part of the ink deposit blocks a nozzle, the shape of the nozzle is changed, and thereby the ejection direction of droplets ejected from the nozzle is changed (i.e., the positions of the recording medium to which the droplets are adhered are changed), resulting in deterioration of the image quality.

SUMMARY

The object of this disclosure is to provide a method for cleaning a droplet ejector, which ejects droplets of a liquid including a solid component from nozzles, to sufficiently clean the nozzles and a nozzle plate bearing the nozzles at a relatively short time.

As an aspect of this disclosure, a method for cleaning a droplet ejector, which includes nozzles to eject droplets of a liquid including a solid component (such as toner composition liquid, hereinafter referred to as a particulate material composition liquid) and a nozzle plate bearing the nozzles, is provided which includes forming a substantially closed cleaning space outside the nozzles and the nozzle plate; supplying a cleaning liquid to the cleaning space so that the nozzles and the nozzle plate are contacted with the cleaning liquid; and vibrating the cleaning liquid when the nozzles and the nozzle plate are contacted with the cleaning liquid to clean the nozzles and the nozzle plate.

As another aspect of this disclosure, a cleaner for cleaning a droplet ejector, which includes nozzles to eject droplets of a particulate material composition liquid from nozzles and a nozzle plate bearing the nozzles, is provided which includes a cleaning space forming device to form a substantially closed cleaning space outside the nozzles and the nozzle plate; a cleaning liquid supplying device to supply a cleaning liquid to the cleaning space; and a vibrator to vibrate the cleaning liquid when the nozzles and the nozzle plate are contacted with the cleaning liquid to clean the nozzles and the nozzle plate.

As another aspect of this disclosure, a particulate material production apparatus is provided which includes a droplet ejector to eject droplets of a particulate material composition liquid in a chamber from nozzles, wherein the chamber includes the nozzles and a nozzle plate bearing the nozzles; a solidifying device to solidify the ejected droplets to form particles of the particulate material composition liquid; and the above-mentioned cleaner to clean the nozzles and the nozzle plate.

The aforementioned and other aspects, features and advantages will become apparent upon consideration of the following description of the preferred embodiments taken in conjunction with the accompanying drawings.

DETAILED DESCRIPTION

Initially, a toner production apparatus, which is a particulate material production apparatus according to an embodiment and in which a toner composition liquid is used as a particulate material composition liquid, will be described.

Figure 1:
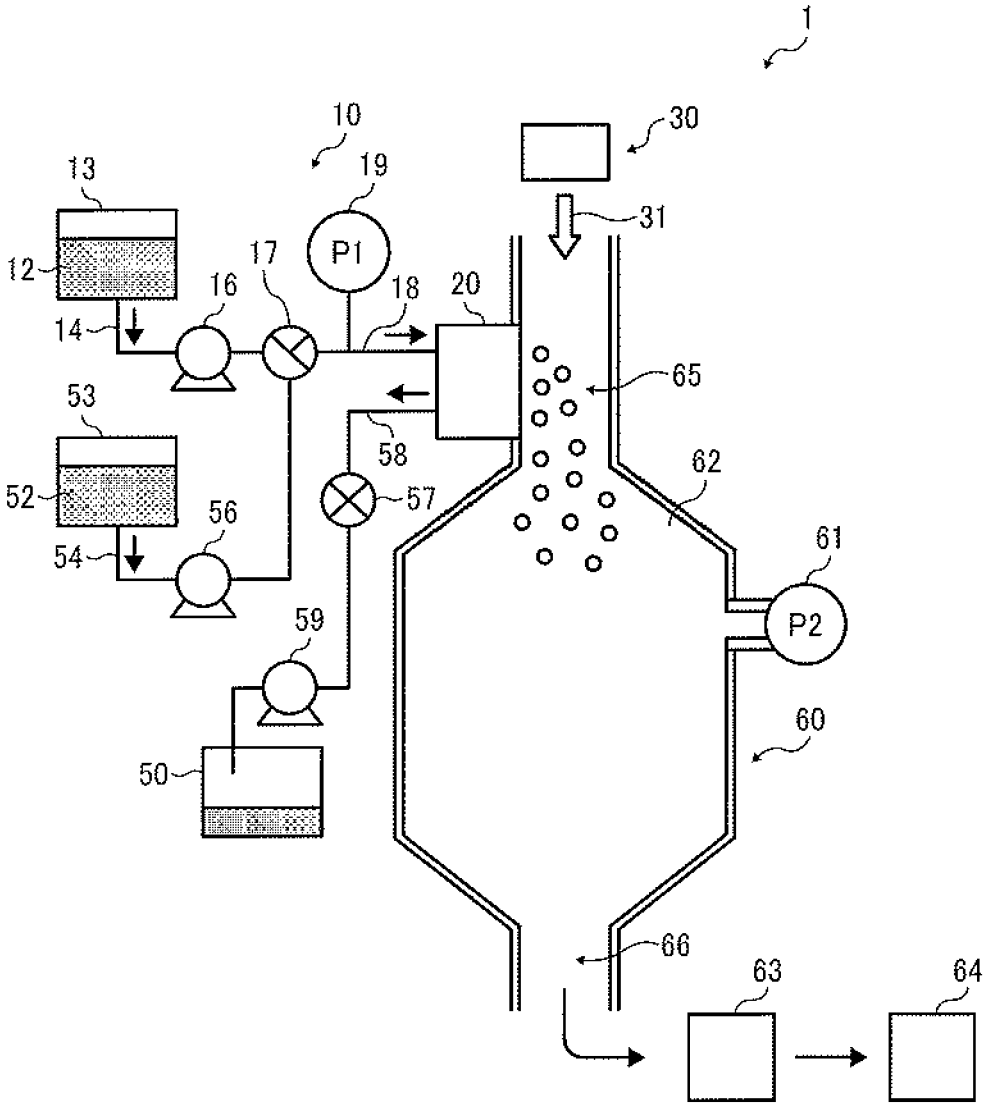
FIG. 1 is a schematic cross-sectional view illustrating a toner production apparatus as a particulate material production apparatus according to an embodiment.

FIG. 1 is a cross-sectional view illustrating the entirety of a toner production apparatus, which is a particulate material production apparatus according to an embodiment.

A toner production apparatus 1 illustrated in FIG. 1 includes a droplet ejecting unit 10, a drying and collecting unit 60 serving as a solidifying device, and a gas feeder 30 (such as air feeder) as main components. The droplet ejecting unit 10 includes a droplet ejector 20 serving as a droplet ejecting device and including multiple droplet ejecting heads to eject droplets of a toner composition liquid (i.e., a liquid including a composition, hereinafter sometimes referred to as a composition liquid) in a liquid column resonance chamber 22 (illustrated in FIG. 2) in a horizontal direction. In the liquid column resonance chamber 22, which is communicated with outside through nozzles 24, a liquid column resonance standing wave is generated under the below-mentioned conditions. The droplet ejector 20 is not limited to a device using a liquid column resonance standing wave as long as the device can eject droplets of a composition liquid from nozzles by changing the internal pressure in a liquid chamber. The gas feeder 30 (hereinafter referred to as an airflow supplier) generates airflow to feed and dry the droplets ejected by the droplet ejector 20. The airflow supplier 30 is not particularly limited as long as the device can generate a flowing gas having a desired flow rate and a desired volume.

The droplet ejector used for the droplet ejector 20 of the particulate material production apparatus is not particularly limited, and any known droplet ejectors can be used. Specific examples of the droplet ejector include one-fluid type nozzles, two-fluid type nozzles, membrane oscillation type ejectors, Rayleigh fission type ejectors, liquid vibration type ejectors, and liquid column resonance type ejectors. Specific examples of the membrane oscillation type ejectors include ejectors disclosed in JP-2008-292976-A (corresponding to US20090317735 incorporated herein by reference). Specific examples of the Rayleigh fission type ejectors include the ejectors disclosed in JP-2007-199463-A or US20060210909 incorporated herein by reference. Specific examples of the liquid vibration type ejectors include the ejectors disclosed in JP-2010-102195-A (corresponding to US20100104970 incorporated herein by reference).

In order to eject droplets having a sharp particle diameter distribution while enhancing the productivity of a particulate material, vibration is applied to a composition liquid of the particulate material in a liquid column resonance chamber having multiple nozzles to form a standing wave. In this regard, the nozzles are located at a location corresponding to an anitnode of the standing wave, and the composition liquid is ejected from the nozzles as droplets.

One of these droplet ejectors is preferably used for the droplet ejector of the particulate material production apparatus.

The droplet ejecting unit 10 includes a toner composition liquid container 13 (i.e., a raw material container), which stores a toner composition liquid 12. In this regard, the toner composition liquid 12 is a liquid in which components constituting a toner composition are dissolved or dispersed in a solvent and which forms particles of the toner when ejected and dried. The toner components will be described later in detail. The toner composition liquid 12 stored in the toner composition liquid container 13 is supplied to the droplet ejector 20 by a toner composition liquid supplying device 16 (i.e., particulate material composition liquid supplying device) through supply tubes 14 and 18 and a switching device 17.

The particulate material production apparatus 1 further includes a cleaner to clean the nozzles of the droplet ejector 20. The cleaner includes a cleaning liquid container 53, which stores a cleaning liquid 52 (i.e., second cleaning liquid). The second cleaning liquid 52 is the same as or different from a first cleaning liquid 44 (illustrated in FIG. 14). The cleaning liquid 52 is preferably a solvent which is the same kind of solvent as used for the toner composition liquid, but is not limited thereto as long as the solvent does not cause a change in the toner composition liquid such as reaction with the toner components, and agglomeration of the components dispersed in the toner composition liquid. The cleaning liquid 52 stored in the cleaning liquid container 53 is supplied to the droplet ejector 20 by a second cleaning liquid supplying device 56 through a supply tube 54, the switching device 17, and the supply tube 18. The switching device 17 performs switching such that the liquid supplied to the droplet ejector 20 is changed from the toner composition liquid 12 to the cleaning liquid 52 or vice versa.

When the liquid (the toner composition liquid or the cleaning liquid) is discharged from the droplet ejector 20, the liquid is fed to a waste liquid container 50 by a discharging device 59 through a discharge tube 58 and a valve 57 to control discharging of the liquid from the droplet ejector 20.

In the following description, the switching device 17 achieves a state in which the toner composition liquid can be fed to the droplet ejector 20 from the toner composition liquid container 13, and the valve 57 achieves a closed state in which the liquid is not fed from the droplet ejector 20 to the waste liquid container 50 unless otherwise specified.

A pressure gauge 19 is provided on the supply tube 18 to measure an inner pressure P1 of the supply tube. In addition, another pressure gauge 61 is provided on the drying and collecting unit 60 to measure an inner pressure P2 of the drying and collecting unit. Specifically, the pressure (P1) of the liquid (e.g., toner composition liquid 12) supplied to the droplet ejector 20 through the supply tube 18 is measured with the pressure gauge 19, and the pressure (P2) in the drying and collecting unit 60 is measured with the pressure gauge 61, to control the pressures P1 and P2. In this regard, when the pressure P1 is higher than the pressure P2, the toner composition liquid may drip from the nozzles of the droplet ejecting heads. In contrast, when the pressure P1 is lower than the pressure P2, air may enter into the droplet ejecting heads from the drying and collecting unit 60, thereby making it impossible to eject droplets of the toner composition liquid 12 from the nozzles. Therefore, it is preferable that the pressures P1 and P2 are substantially the same.

The toner composition liquid supplying device 16, the second cleaning liquid supplying device 56, and the discharging device 59 are not particularly limited, and any known devices capable of feeding a liquid while performing pressure controlling can be used therefor. Specific examples thereof include syringe pumps, tube pumps, and gear pumps. In addition, instead of such mechanical liquid feeding devices, a method in which the toner composition liquid container 13, the cleaning liquid container 53 and the waste liquid container 50 are closed while controlling the pressures in the containers can also be used.

Figure 2:
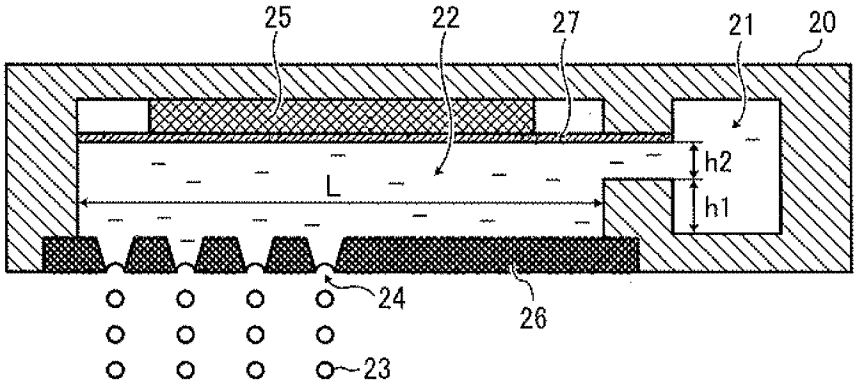
FIG. 2 is a schematic cross-sectional view illustrating a droplet ejecting head of the toner production apparatus illustrated in FIG. 1.

FIG. 2 is a cross-sectional view illustrating the droplet ejecting head (i.e., part of the droplet ejector 20). As illustrated in FIG. 2, the droplet ejecting head of the droplet ejector 20 includes a common liquid passage 21 and the liquid column resonance chamber 22. The liquid column resonance chamber 22 is communicated with the common liquid passage 21, which is provided on one of end walls in the longitudinal direction of the liquid column resonance chamber. The liquid column resonance chamber 22 has another wall connected with the end walls and having droplet ejection nozzles 24 to eject droplets 23 of the toner composition liquid 12, and a vibrator 25 generating high-frequency vibration to form a liquid column resonance wave in the liquid column resonance chamber 22. The vibrator 25 is connected with a high-frequency power source.

Referring back to FIG. 1, the drying and collecting unit 60 includes a chamber 62, a toner collector 63, and a toner container 64. A carrier gas (such as air) 31 (hereinafter sometimes referred to as carrier air or airflow) is downwardly fed to the chamber 62 by a gas feeder 30 (hereinafter referred to as an air feeder) such as a blower. The flow direction of the carrier air 31 is substantially perpendicular to the ejection direction of droplets ejected by the droplet ejector 20. When the direction of the carrier air 31 is substantially perpendicular to the droplet ejection direction, the droplet flight velocity can be increased, thereby making it possible to prevent uniting of the ejected droplets.

Specifically, since the droplets 23 of the toner composition liquid 12 ejected from the nozzles 24 of the droplet ejector 20 are fed downward by the gravity and the downward airflow 31, the velocity of the droplets 23 is increased, thereby preventing the velocity of the droplets from being decreased due to friction between the droplets and air. In addition, since the flight direction of the droplets is changed by the carrier air 31, the distance between the droplets is increased. Therefore, occurrence of the droplet uniting problem can be prevented. In order to generate the carrier air 31, a method in which a blower is provided on an upper portion of the chamber 62 as the airflow supplier 30 (illustrated in FIG. 1) to pressure-feed air downward, a method in which air is sucked from the toner collector 63, or the like method can be used.

Swirling airflow swirling around a vertical axis is formed in the toner collector 63 by a swirling airflow generator. The toner particles collected by the toner collector 63 are fed to the toner container 64 through a toner collection tube connecting the chamber 62 with the toner container 64 through the toner collector 63.

The droplets 23 of the toner composition liquid 12 (i.e., liquid toner particles) ejected from the nozzles 24 toward the chamber 62 are gradually dried in the chamber 60 as the solvent included in the droplets is evaporated (for example, by being heated), and finally solid toner particles are formed in the chamber 62. The solid toner particles are collected by the toner collector 63, and then stored in the toner container 64. The toner particles stored in the toner container 64 may be subjected to an additional drying treatment if desired.

Next, the toner production process using the toner production apparatus of this disclosure will be described.

Figure 3:
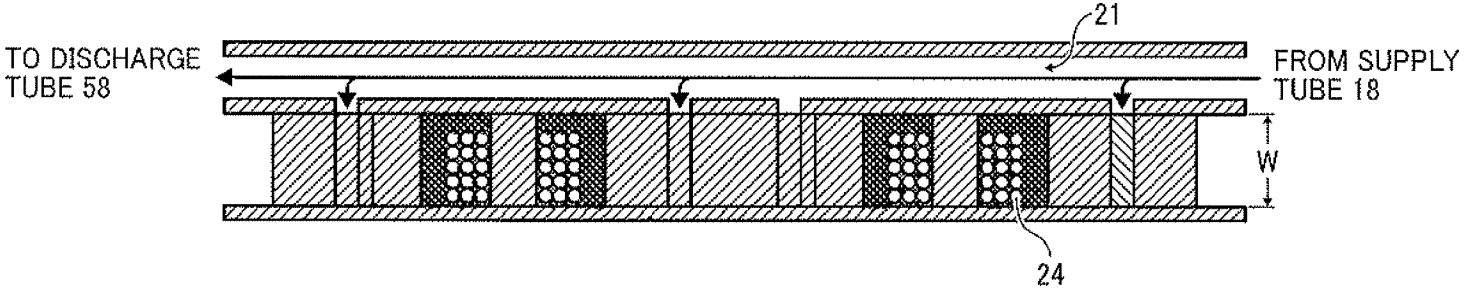
FIG. 3 is a schematic cross-sectional view illustrating a droplet ejector including plural droplet ejecting heads.

Referring to FIG. 1, the toner composition liquid 12 contained in the toner composition liquid container 13 is fed by the toner composition liquid supplying device 16 to the common liquid passage 21 of the droplet ejector 20 (illustrated in FIGS. 2 and 3) through the supply tubes 14 and 18, so that the toner composition liquid is supplied to the liquid column resonance chambers 22 of the droplet ejecting heads of the droplet ejector 20. In the liquid column resonance chamber 22 containing the toner composition liquid 12 therein, a pressure distribution is caused by a liquid column resonance standing wave generated by the vibrator 25. In this regard, droplets 23 of the toner composition liquid 12 are ejected from the droplet ejection nozzles 24, which are arranged at a location of the liquid column resonance chamber 22 corresponding to an antinode (i.e., maximum amplitude point) of the liquid column resonance standing wave, at which pressure largely fluctuates.

In this application, the antinode of a standing wave means an area of the standing wave other than an area of a wave node of the standing wave. It is preferable that at the area the standing wave has a large amplitude (i.e., a large pressure fluctuation) sufficient to eject droplets, and it is more preferable that the area is present in a region (hereinafter sometimes referred to as an antinode region) in which the maximum amplitude point of the pressure standing wave (i.e., the wave node of the velocity standing wave) is the center of the region and which has a length (width) of +¼ of the wavelength of the standing wave on both sides of the center. When the multiple droplet ejection nozzles 24 are present in the antinode region, droplets ejected from the nozzles have substantially the same particle size. In addition, since multiple nozzles can be used, droplets can be efficiently produced and chance of occurrence of a nozzle clogging problem in that the nozzles are clogged with the toner composition liquid can be reduced.

When the amount of the toner composition liquid 12 in the liquid column resonance chamber 22 is decreased due to ejection of the toner composition liquid 12 from the nozzles 24, the force of sucking the toner composition liquid is increased by the action of the liquid column resonance standing wave in the liquid column resonance chamber 22, thereby increasing the amount of the toner composition liquid supplied to the liquid column resonance chamber 22 from the common liquid passage 21. Therefore, the liquid column resonance chamber 22 is replenished with the toner composition liquid 12. When the liquid column resonance chamber 22 is replenished with the toner composition liquid 12, the flow rate of the toner composition liquid flowing through the common liquid passage 21 increases so as to be the normal flow rate, and feeding of the toner composition liquid from the container 13 to the droplet ejector 20 through the supply tubes 14 and 18 is normalized.

In the droplet ejecting operation, the toner composition liquid feeding pressure measured with the pressure gauge 19 is preferably from −2 to +2 kPa, and the pressure is adjusted by the toner composition liquid supplying device 16. Even when the toner composition liquid feeding pressure is a small negative pressure, the liquid can be supplied to the droplet ejector 20 due to the voluntary liquid supply principle mentioned above. When the liquid feeding pressure is lower than −2 kPa, air bubbles tend to be included in the chamber 22, resulting occurrence of non-ejection of droplets. When the toner composition liquid feeding pressure is higher than +2 kPa, the toner composition liquid tends to exude from the nozzles 24, resulting in occurrence of a problem in that the nozzles are clogged with a dried material of the liquid, thereby causing unstable droplet ejection. When the cleaning liquid 52 is supplied, the liquid feeding pressure is not limited thereto.

The liquid column resonance chamber 22 is preferably constituted of frames, which are connected with each other and which are made of a material having a high rigidity (such as metals, ceramics and silicon) such that the resonance frequency of the toner composition liquid in the liquid column resonance chamber 22 is not affected by the frames. In addition, as illustrated in FIG. 2, a length L between two opposed longitudinal end walls of the liquid column resonance chamber 22 is determined based on the liquid column resonance principle mentioned below. Further, a width W (illustrated in FIG. 3) of the liquid column resonance chamber 22 is preferably less than ½ of the length L so as not to apply an extra frequency, by which the liquid column resonance is influenced. Furthermore, it is preferable to provide multiple liquid resonance chambers in one droplet ejector 20 to dramatically improve the productivity of the toner. The number of liquid resonance chambers in one droplet ejector 20 is preferably from 100 to 2,000 so that the toner production apparatus has a good combination of productivity and operability. In this case, each of the liquid resonance chambers is connected with the common liquid passage 21, i.e., the common liquid passage 21 is connected with multiple liquid column resonance chambers 22, and therefore the toner composition liquid can be supplied to each liquid resonance chamber. Since the common liquid passage 21 is connected with the discharge tube 58, the liquid in the droplet ejector 20 can be discharged if desired.

The vibrator 25 of the droplet ejector 20 is not particularly limited as long as the vibrator can vibrate (operate) at a predetermined frequency, but a material in which a piezoelectric material is laminated to an elastic plate 27 is preferably used. In this regard, the elastic plate 27 prevents the piezoelectric material form being contacted with the toner composition liquid, and constitutes part of the wall of the liquid column resonance chamber 22. Specific examples of the materials for use as the piezoelectric material include piezoelectric ceramics such as lead zirconate titanate (PZT). However, in general displacement of such a material is small, and therefore laminated materials in which several piezoelectric materials are laminated are typically used. In addition, other piezoelectric materials such as polyvinylidene fluoride (PVDF) and single crystals (e.g., quart, $LiNbO_3$, $LiTaO_3$, and $KNbO_3$) can also be used. The vibrator 25 is preferably arranged in each of the liquid column resonance chambers 22 to control vibration of the chamber. In addition, the vibrator 25 preferably has a structure such that a block of a vibrating member is set in the entirety of the liquid column resonance chambers while partially cut so that the vibrating member is arranged in each liquid column resonance chamber and vibration of each liquid column resonance chamber can be separately controlled via the elastic plate 27.

The diameter of each of the droplet ejection nozzles 24 is preferably from 1 μm to 40 μm. When the diameter is less than 1 μm, the diameter of ejected droplets becomes too small, and therefore there is a case where toner particles having a desired particle diameter is not produced. In addition, when the toner composition liquid includes a particulate material, the nozzle clogging problem is often caused, thereby deteriorating the productivity. In contrast, when the diameter is greater than 40 μm, the diameter of ejected droplets becomes too large. When toner particles having a diameter of from 3 μm to 6 μm are prepared using such large droplets, the toner composition liquid has to have a low solid content (i.e., the toner composition liquid has to include a large amount of solvent), and a large amount of energy is used for drying the ejected droplets, resulting in deterioration of productivity and increase of production costs. When the diameter of the nozzles 24 is from 6 μm to 12 μm, it is possible to form nozzles with small diameter variation, thereby enhancing the productivity of the toner.

It is preferable to form plural nozzles 24 in a liquid column resonance chamber 22 as illustrated in FIG. 2 to enhance the productivity of the product (such as toner). Since the liquid column resonance frequency changes depending on the arrangement of the droplet ejection nozzles 24, it is preferable to properly determine the liquid column resonance frequency by checking whether desired droplets are ejected from the nozzles 24.

The nozzles 24 are through-holes formed in a nozzle plate 26. The shape of the through-holes is not particularly limited. For example, the nozzles can have a shape such that the diameter of the nozzles decreases in a direction of from the inner surface of the nozzle plate 26 contacting the toner composition liquid to the outer surface of the nozzle plate while the inner surface of the nozzle is rounded, or a shape such that the diameter decreases in a direction of from the inner surface of the nozzle plate 26 contacting the toner composition liquid to the outer surface of the nozzle plate at a certain rate (i.e., the inner surface of the nozzle is tapered at a certain angle). By using such nozzles, droplet ejection stability can be improved.

The surface of the nozzle plate 26, which includes the nozzles 24, is preferably subjected to a liquid repellent treatment so that wetting of the surface of the nozzle plate with the toner composition liquid can be controlled, and thereby droplet ejection stability can be enhanced. The liquid repellent treatment will be described in detail.

(Liquid Repelling Layer)

Figure 16A:
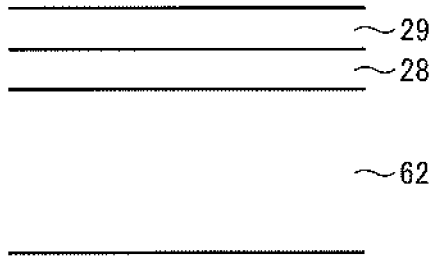
FIGS. 16A and 16B illustrate a liquid repelling layer formed on the inner surface of a chamber of the toner production apparatus and the surface of a nozzle plate.
Figure 16B:
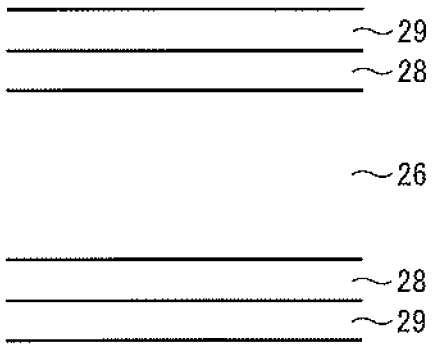

The liquid repelling layer formed on the nozzle plate by a liquid repellent treatment will be described. As illustrated in FIG. 16B, the entire surface of the nozzle plate 26 preferably has a $SiO_2$ layer 28 and a liquid repelling layer 29 located on the $SiO_2$ layer. It is preferable for the liquid repelling layer to include a material having a linear perfluoroalkyl group having the following formula (1) or (2) or an alkyl group having a sixalane bond (—SiO—) with a perfluoropolyether group and having the following formula (3) or (4):

$$CF_3(CF_2)_n—Si(OR)_3 \quad (1),$$

$$CF_3(CF_2)_n—Si(OR^1)_2R^2 \quad (2),$$

$$CF_3(OCF_2—CF_2CF_2)_n—X—Si(OR)_3 \quad (3), \text{ and}$$

$$CF_3(OCF_2—CF_2CF_2)_n—X—Si(OR^1)_2R^2 \quad (4).$$

In formulae (1) to (4), X is not particularly limited. In addition, each of R, $R^1$, and $R^2$ is alkyl group (a binding site of a $SiO_2$ layer), and the more the number of the binding sites, the stronger the binding force of the repelling layer with the $SiO_2$ layer. Therefore, the number of the binding sites is preferably three. The perfluoroalkyl group of the material is present on the surface of the liquid repelling layer so as to be contacted with the particulate material composition liquid (i.e., so as to repel the particulate material composition liquid).

(Liquid Repelling Layer Forming Process)

The liquid repelling layer can be formed by a vacuum deposition method, which is described layer, hut is not limited thereto. For example, spray coating methods, spin coating methods, dip coating methods, and printing methods can also be used. When using these coating and printing methods, it is preferable to dilute such a fluorine-containing material as mentioned above with a solvent so that the coating liquid can be easy to handle and a thin film can be formed.

Specific examples of the solvent include fluorine-containing solvents such as perfluorohexane, perfluoromethylcyclohexane, and FLUORINERT FC-72 (from Sumitomo 3M Ltd.).

In the liquid repelling layer forming process, initially a $SiO_2$ layer with a thickness of a few nanometers to tens of nanometers is formed on the liquid ejection surface side by radio frequency sputtering (i.e., first step). Next, the layer is subjected to a degreasing/washing treatment (second step), and the $SiO_2$ layer is then subjected to vacuum vapor deposition using such a fluorine-containing material as mentioned above (third step), followed by a calcination treatment or a polymerization treatment (fourth step). Thus, a liquid repelling layer can be formed.

(Thickness of the Liquid Repelling Layer)

The thickness of the liquid repelling layer can be controlled by controlling the vacuum deposition time, and is preferably not less than 10 nm. When the thickness is less than 10 nm, the layer tends to be gradually peeled after long repeated use.

The thus formed liquid repelling layer preferably has a contact angle of not less than 40 degree against the toner composition liquid used so that the layer has good liquid repelling property.

Next, the mechanism of forming droplets in the droplet ejecting unit of the toner production apparatus will be described.

Initially, the principle of the liquid column resonance phenomenon caused in the liquid column resonance chamber 22 of the droplet ejector 20 will be described. The wavelength (λ) of resonance of the toner composition liquid in the liquid column resonance chamber 22 is represented by the following equation (1):

$$\lambda + c/f \quad (1),$$

wherein c represents the acoustic velocity in the toner composition liquid, and f represents the frequency of vibration applied to the toner composition liquid by the vibrator 25.

As illustrated in FIG. 2, the length between the end wall of the liquid column resonance chamber 22 to the other end wall closer to the common liquid passage 21 is L, and the end wall closer to the common liquid passage has a height of h1 while the opening communicating the liquid column resonance chamber 22 with the common liquid passage 21 has a height of h2. When the height h1 is twice the height h2 (e.g., h1 is about 80 μm, and h2 is about 40 μm) and it is provided that both the end walls are equivalent to fixed ends (i.e., the chamber 22 has two fixed ends), resonance can be formed most efficiently if the length L satisfied the following equation (2):

$$L = (N/4)\lambda \quad (2),$$

wherein N is an even number.

In a chamber having two open ends, the above-mentioned equation (2) is also satisfied.

Similarly, in a chamber having one fixed end and one open end, resonance can be formed most efficiently when N is an odd number in equation (2).

The frequency of vibration f (most efficient frequency) at which the resonance can be formed most efficiently can be obtained from the following equation (3), which is obtained from equations (1) and (2):

$$f=N\times c/(4L) \quad (3).$$

However, since liquids have viscosity, the resonance is decayed, and vibration is not endlessly amplified. Namely, a liquid has a Q value, and the liquid can cause resonance even at a frequency in the vicinity of the above-mentioned most efficient frequency f represented by equation (3).

FIGS. 4A-4D illustrate standing waves (in a resonance mode) of velocity fluctuation and pressure fluctuation when N is 1, 2 or 3. FIGS. 5A-5C illustrate standing waves (in a resonance mode) of velocity fluctuation and pressure fluctuation when N is 4 or 5. In reality, each of the waves is a compression wave (longitudinal wave), but is generally illustrated as the waves in FIGS. 4 and 5. In FIGS. 4 and 5, a velocity standing wave is illustrated by a solid line, and a pressure standing wave is illustrated by a dotted line.

Figure 4A:
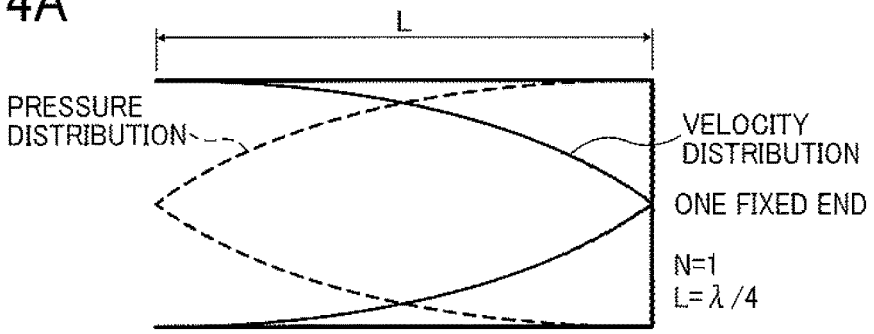
FIGS. 4A-4D are schematic views illustrating the velocity distribution and pressure distribution of standing waves formed when N=1, 2 or 3.
Figure 5A:
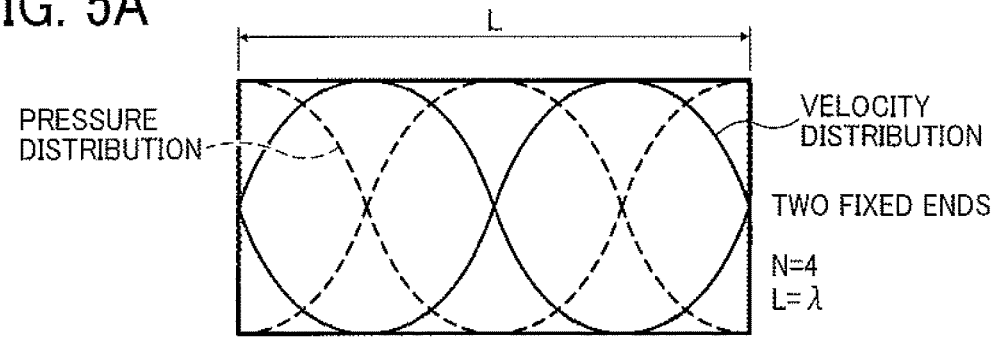
FIGS. 5A-5C are schematic views illustrating the velocity distribution and pressure distribution of standing waves formed when N=5 or 6.
Figure 5B:
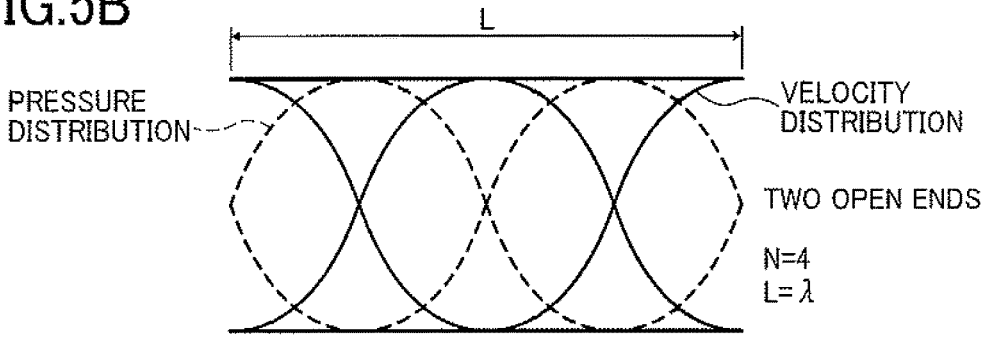
Figure 5C:
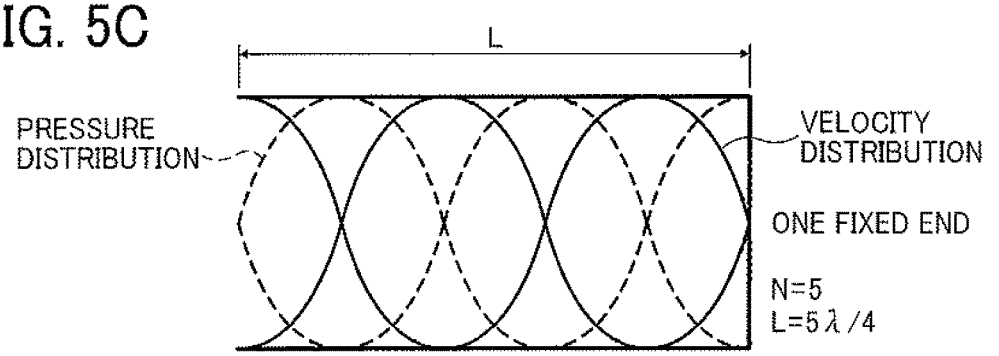

For example, in a case illustrated in FIG. 4A in which the liquid column resonance chamber has one fixed end and N is 1, the frequency of the velocity distribution becomes zero at the closed end, and has a maximum value at the open end. When the length of the liquid column resonance chamber is L, the wavelength of resonance is λ, and N is 1, 2, 3, 4 or 5, the standing wave can be formed most efficiently.

Since the shape of the standing wave changes depending on the states (i.e., opened or closed state) of both the ends of the liquid column resonance chamber, both the cases (i.e., opened or closed state) are illustrated in FIGS. 4 and 5. As mentioned later, the states of the ends are determined depending on the conditions of the openings of the droplet ejection nozzles 24 and the opening connecting the liquid column resonance chamber 22 with the common liquid passage 21. In acoustics, an open end means an end at which the moving velocity of a medium (liquid) becomes zero, and the pressure is maximized. In contrast, at a closed end, the moving velocity of a medium is zero. The closed end is considered to be a hard wall in acoustics, and reflection of a wave is caused. When the liquid column resonance chamber has an ideal open end and/or an ideal closed end as illustrated in FIGS. 4 and 5, such resonance standing waves as illustrated in FIGS. 4 and 5 are formed due to overlapping of waves.

However, the shape of the standing waves is changed depending on the number of the droplet ejection nozzles 24 and the positions of the nozzles, and therefore the most efficient frequency f may be slightly different from that obtained from equation (3). In such a case, by properly adjusting the drive frequency, stable ejection conditions can be established. For example, in a case where the acoustic velocity c is 1,200 m/s in the liquid, the length L of the chamber is 1.85 mm, both the ends are closed ends (walls), and the resonance mode is an N=2 mode, the most efficient frequency f is determined as 324 kHz from equation (2). In addition, in a case where the acoustic velocity c is 1,200 m/s in the liquid, the length L of the chamber is 1.85 mm, both the ends are closed ends (walls), and the resonance mode is an N=4 mode, the most efficient frequency f is determined as 648 kHz from equation (2). In the latter case, higher-degree resonance than in the former case can be used.

Figure 4B:
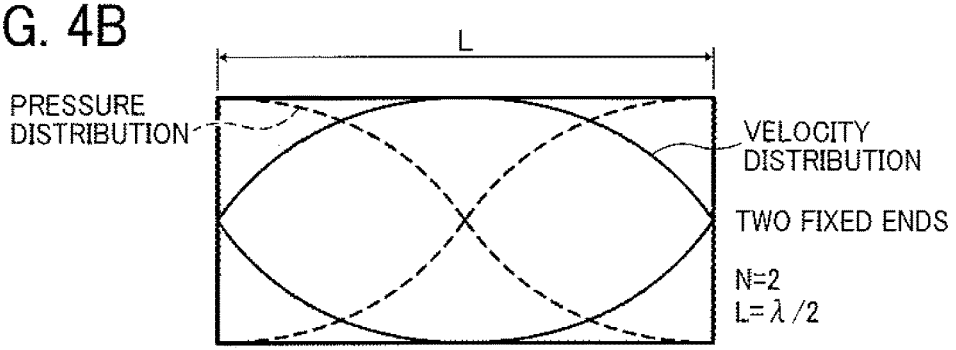
Figure 4C:
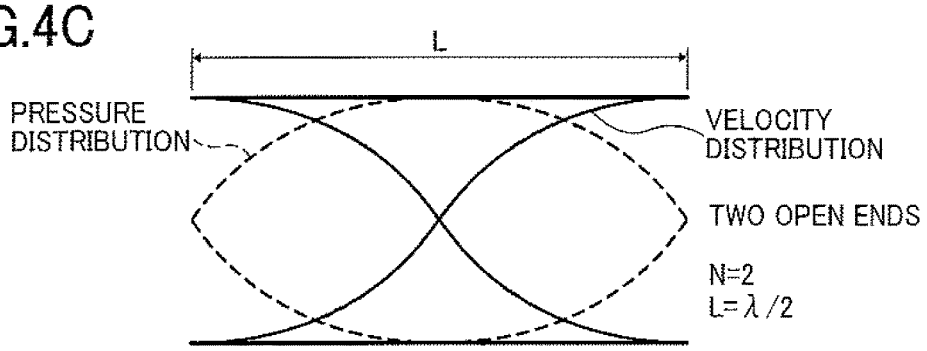
Figure 4D:
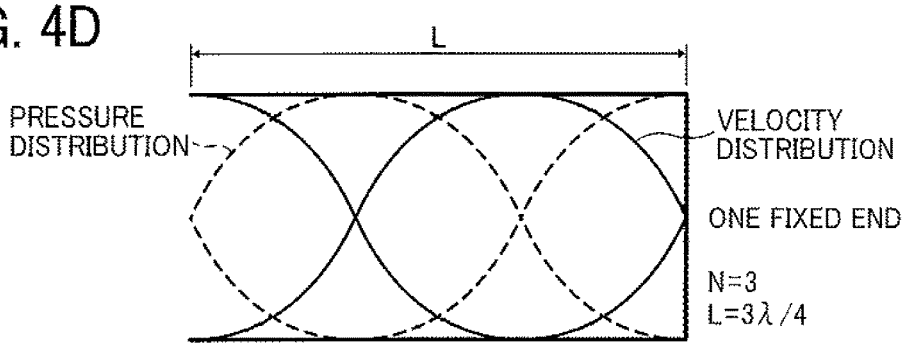

The liquid column resonance chamber 22 of the droplet ejector 20 illustrated in FIGS. 1 and 2 is equivalent to a chamber having two closed ends. It is preferable that the wall having the droplet ejection nozzles 24 is an acoustically soft wall (due to the openings of the nozzles) to increase the most efficient frequency. However, the liquid column resonance chamber 22 is not limited thereto, and can have two open ends. In this regard, the influence of the openings of the droplet ejection nozzles is such that the acoustic impedance is decreased thereby, and particularly the compliance is increased thereby. Therefore, the liquid column resonance chamber 22 preferably has such a structure as illustrated in FIG. 4B or 5A (i.e., the chamber has a wall at both the ends thereof) because both the resonance mode in the two-closed-end structure and the resonance mode in the one-open-end structure in which the wall on the nozzle side is considered to be an open end can be used.

The drive frequency is preferably determined depending on factors such as the number of openings (nozzles), the positions of the openings and the cross-sectional shape of the openings. For example, when the number of openings is increased, the fixed end of the liquid column resonance chamber is loosely bounded so as to be similar to an open end, and the generated standing wave becomes similar to a standing wave formed in a chamber having one open end, resulting in increase of the drive frequency. In this regard, when the wall of the liquid column resonance chamber having the nozzles is loosely restricted because the position of the opening (nozzle) closest to the end of the chamber closer to the common liquid supply 21 is relatively close to the end of the chamber, or when the nozzles 24 have a round cross-section, or the volume of the nozzles varies depending on the thickness of the frame of the chamber having the nozzles, the real standing wave has a shorter wavelength, and therefore the frequency of the wave becomes higher than the drive frequency. When a voltage is applied to the vibrator to generate the thus determined drive frequency (most efficient drive frequency), the vibrator is deformed and thereby a resonance standing wave can be generated most efficiently. In this regard, a resonance standing wave can also be generated at a drive frequency in the vicinity of the most efficient drive frequency. When the length of the liquid column resonance chamber 22 in the longitudinal direction thereof is L, and the length between the end wall of the chamber closer to the common liquid supply 21 and the nozzle closest to the end wall is Le, droplets of the toner composition liquid 12 can be ejected from the nozzles by liquid column resonance caused by vibrating the vibrator using a drive wave including, as a main component, a drive frequency f in the range represented by the following relationships (4) and (5):

$$N\times c/(4L)\leq f\leq N\times c/(4Le) \quad (4), \text{ and}$$

$$N\times c/(4L)\leq f\leq (N+1)\times c/(4Le) \quad (5).$$

The ratio (Le/L) of the length between the end wall of the chamber closer to the common liquid supply 21 and the nozzle closest to the end wall Le to the length of the liquid column resonance chamber 22 in the longitudinal direction thereof L is preferably greater than 0.6.

As mentioned above, by using the liquid column resonance phenomenon, a liquid column resonance standing wave of pressure is formed in the liquid column resonance chamber 22 illustrated in FIG. 2, thereby continuously ejecting droplets of the toner composition liquid from the liquid election nozzles 24 of the liquid column resonance chamber. In this regard, it is preferable that the liquid ejection nozzles 24 are formed on a position, at which the pressure of the standing wave varies most largely, because the droplet ejecting efficiency is enhanced, and thereby the liquid ejector 20 can be driven at a low voltage.

Although it is possible for the liquid column resonance chamber 22 to have only one liquid ejection nozzle, it is preferable for the chamber to have multiple liquid ejection nozzles, preferably from 2 to 100 nozzles, to enhance the productivity of the product (toner). When the number of nozzles is greater than 100, the voltage applied to the vibrator 25 has to be increased in order to form droplets having a desired particle diameter. In this case, the piezoelectric material serving as the vibrator tends to operate unstably. The distance between two adjacent nozzles is preferably not less than 20 μm and less than the length L of the liquid column resonance chamber 22. When the distance between two adjacent nozzles is less than 20 μm, chance of collision of droplets ejected from the two adjacent nozzles is increased, thereby forming united particles, resulting in deterioration of the particle diameter distribution of the resultant toner.

Next, the liquid column resonance phenomenon caused in the liquid column resonance chamber 22 of the droplet ejecting head will be described by reference to FIGS. 6A-6D. In FIGS. 6A-6D, a solid line represents the velocity distribution of the toner composition liquid 12 at any position of from the fixed end to the other end closer to the common liquid passage 21 (illustrated in FIG. 2). In this regard, when the solid line is present in a positive (+) region, the toner composition liquid 12 flows from the common liquid passage 21 toward the liquid column resonance chamber 22. When the solid line is present in a negative (−) region, the toner composition liquid 12 flows in the opposite direction. A dotted line represents the pressure distribution of the toner composition liquid 12 at any position of from the fixed end to the other end closer to the common liquid passage 21. In this regard, when the dotted line is present in a positive (+) region, the pressure in the chamber 22 is higher than atmospheric pressure (i.e., the pressure is a positive pressure). When the dotted line is present in a negative (−) region, the pressure is lower than atmospheric pressure the pressure is a negative pressure). Specifically, when the pressure in the chamber 22 is a positive pressure, a downward pressure is applied to the toner composition liquid 12 in FIG. 6. In contrast, when the pressure is a negative pressure, an upward pressure is applied to the toner composition liquid in FIG. 7. In this regard, although the end of the liquid column resonance chamber 22 closer to the common liquid passage 21 is opened as mentioned above, the height (h1 in FIG. 2) of the frame (fixed end) of the liquid column resonance chamber 22 is not less than about twice the height (h2 in FIG. 2) of the opening connecting the chamber 22 with the common liquid passage 21, and therefore temporal changes of the velocity distribution curve and the pressure distribution curve are illustrated in FIGS. 6A-6D while assuming that the liquid column resonance chamber 22 has two fixed ends.

Figure 6A:
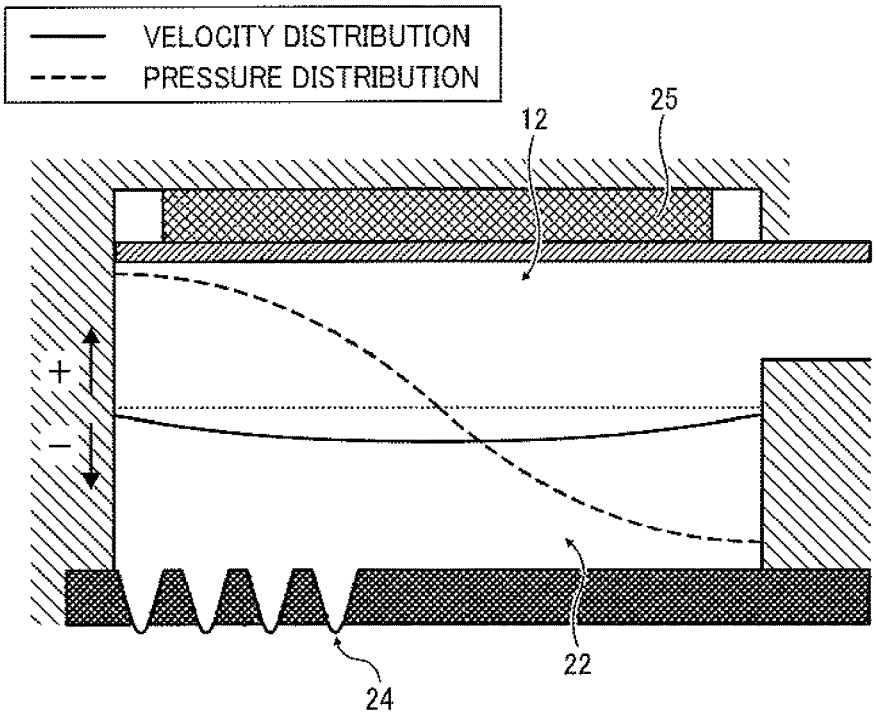
FIGS. 6A-6D are schematic views illustrating how liquid column resonance is caused in a liquid column resonance chamber of the droplet ejecting head.
Figure 6B:
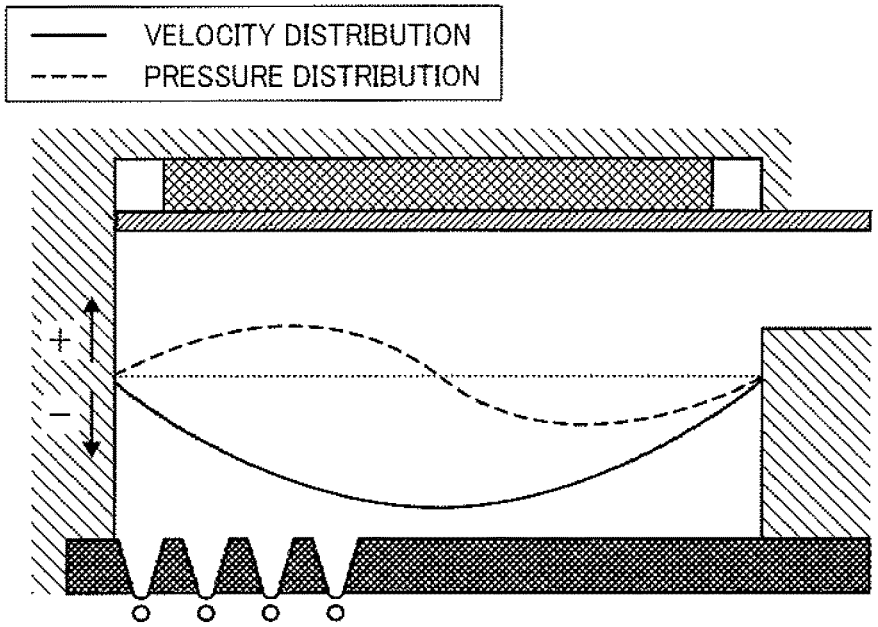

FIG. 6A illustrates the pressure waveform and the velocity waveform in the liquid column resonance chamber 22 just after droplets are ejected from the droplet ejection nozzles 24, and FIG. 6B illustrates the pressure waveform and the velocity waveform in the liquid column resonance chamber 22 at a time when the toner composition liquid is sucked just after droplets are ejected. As illustrated in FIG. 6A, the pressure in a portion of the toner composition liquid 12 above the nozzles 24 in the liquid column resonance chamber 22 is maximized. In FIG. 6A, the flow direction of the toner composition liquid 12 in the liquid column resonance chamber 22 is the direction of from the nozzles 24 to the common liquid passage 21 and the velocity thereof is low. Next, as illustrated in FIG. 6B, the positive pressure in the vicinity of the nozzles 24 is decreased, so that the pressure is changed toward a negative region (pressure). In this case, the flow direction of the toner composition liquid 12 is not changed, but the velocity of the toner composition liquid is maximized, thereby ejecting droplets of the toner composition liquid.

Figure 6C:
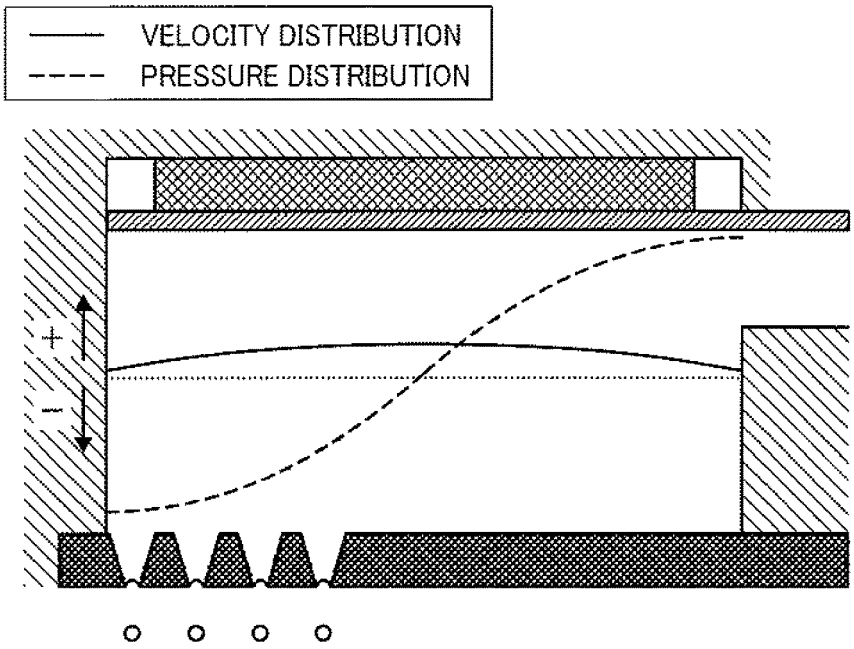
Figure 6D:
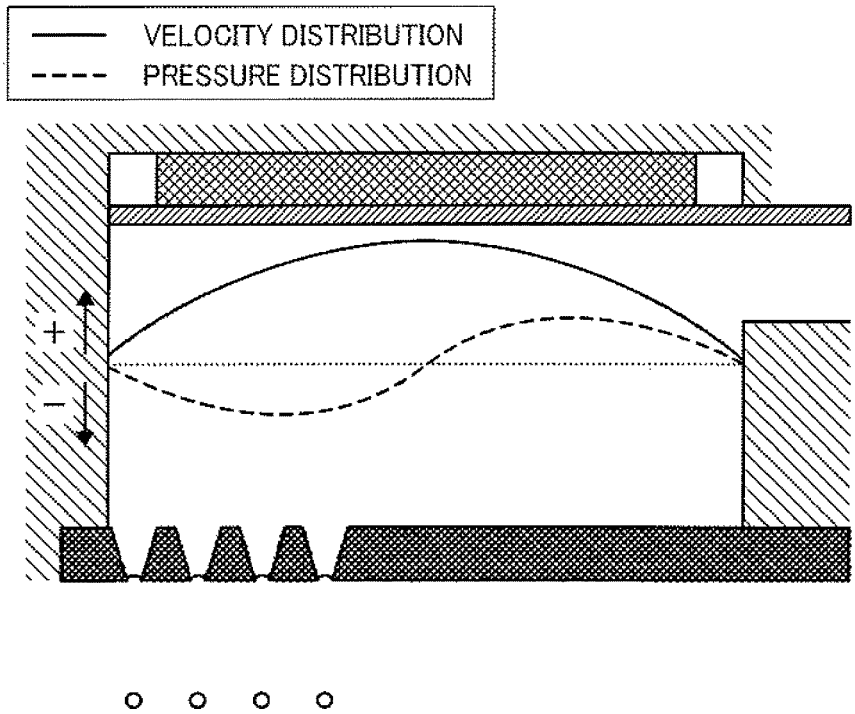

After droplets are ejected, the pressure in the vicinity of the droplet ejection nozzles 24 is minimized (i.e., maximized in the negative region) as illustrated in FIG. 6C. In this case, feeding of the toner composition liquid 12 to the liquid column resonance chamber 22 from the common liquid passage 21 is started. Next, as illustrated in FIG. 6D, the negative pressure in the vicinity of the nozzles 24 is decreased, so that the pressure is changed toward a positive pressure. Thus, the liquid filling operation is completed. Next, the positive pressure in the liquid column resonance chamber 22 is maximized as illustrated in FIG. 6A, and then the droplets 23 of the toner composition liquid 12 are ejected as illustrated in FIG. 6B.

Thus, since a liquid column resonance standing wave is formed in the liquid column resonance chamber 22 by driving the vibrator with a high frequency wave, and in addition the droplet ejection nozzles 24 are arranged at a location corresponding to the antinode of the standing wave at which the pressure varies most largely, the droplets 23 of the toner composition liquid 12 can be continuously ejected from the droplet ejection nozzles 24 according to the cycle of the antinode.

Figure 7:
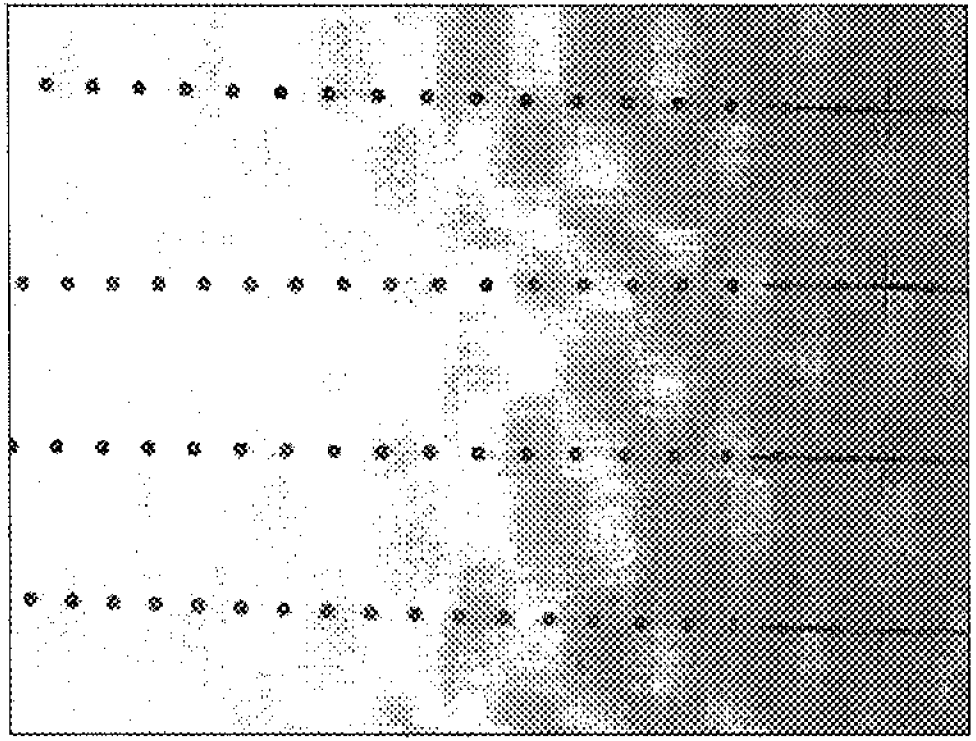
FIG. 7 is a photograph of droplets ejected from the droplet ejector, which is taken by a laser shadowgraphy method.

An experiment on this droplet ejection operation was performed. Specifically, in the droplet ejector 20 used for this experiment, the length (L) of the liquid column resonance chamber 22 is 1.85 mm, and the resonance mode is an N=2 resonance mode. In addition, the droplet ejection nozzles 24 have four nozzles (i.e., first to fourth nozzles) at a location corresponding to the antipode of the pressure standing wave in the N=2 resonance mode. Further, a sine wave having a frequency of 340 kHz is used to eject droplets of a toner composition liquid. FIG. 7 is a photograph, which is taken by using a laser shadowgraphy method and which shows droplets of the toner composition liquid ejected from the four nozzles. It can be understood from FIG. 7 that droplets having substantially the same particle diameter can be ejected from the four nozzles at substantially the same velocity.

Figure 8:
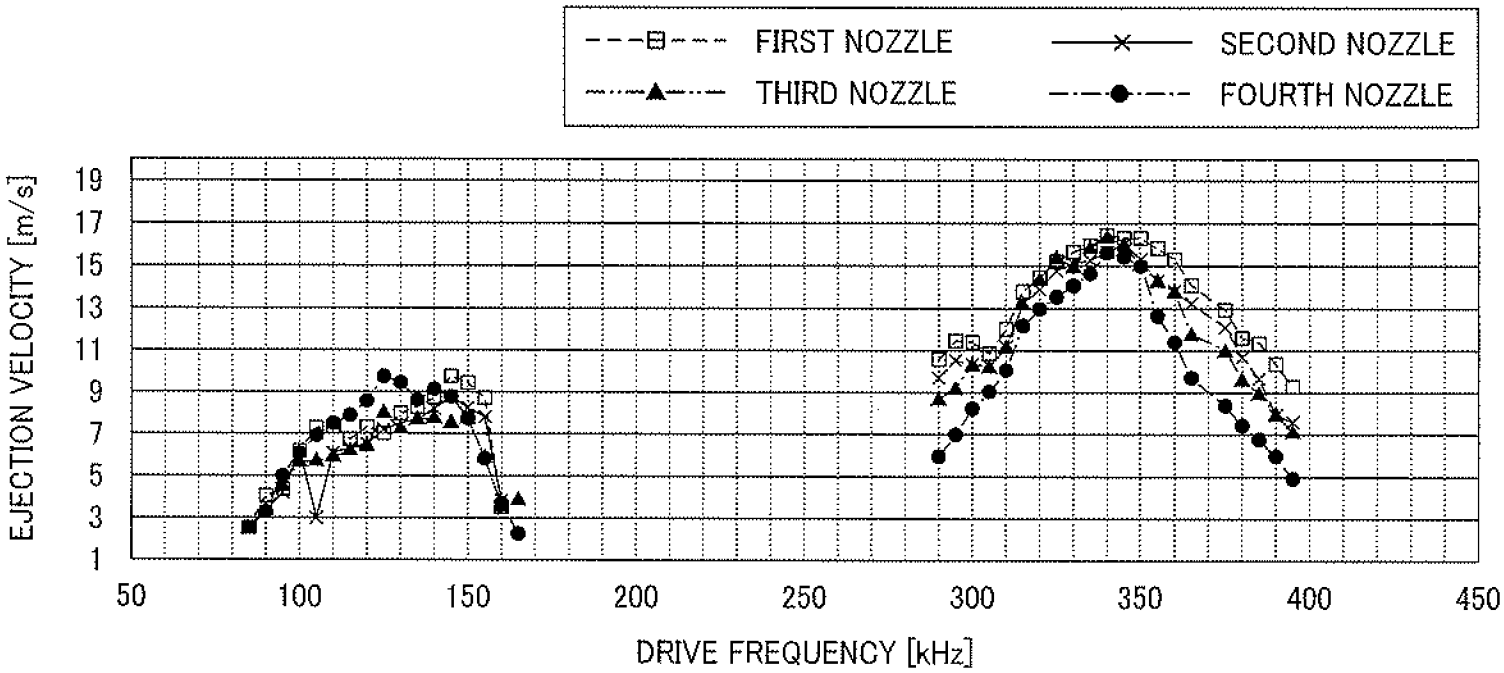
FIG. 8 is a graph showing the relation between the drive frequency of vibration and the velocity of ejected droplets.

FIG. 8 is a graph showing the velocity of droplets ejected from the first to fourth nozzles when using a sine wave with a drive frequency in a range of from 290 kHz to 395 kHz. It can be understood from FIG. 8 that at the frequency of 340 kHz, the velocities of droplets ejected from the first to fourth nozzles are substantially the same while the velocities are maximized. Namely, it could be confirmed that droplets of the toner composition liquid are evenly ejected from the antinode of the liquid column resonance standing wave when the second mode is used (i.e., when the liquid column resonance frequency is 340 kHz). In addition, the velocities of droplets ejected from the first to fourth nozzles when the first mode is used (i.e., when the liquid column resonance frequency is 130 kHz) are shown on the left side of the graph (FIG. 8). It can also be understood from FIG. 8 that droplets are not ejected at frequencies between the first mode (130 kHz) and the second mode (340 kHz). This frequency characteristic is specific to liquid column resonance standing waves, and therefore it was confirmed that liquid column resonance occurs in the chamber 22.

Figure 9:
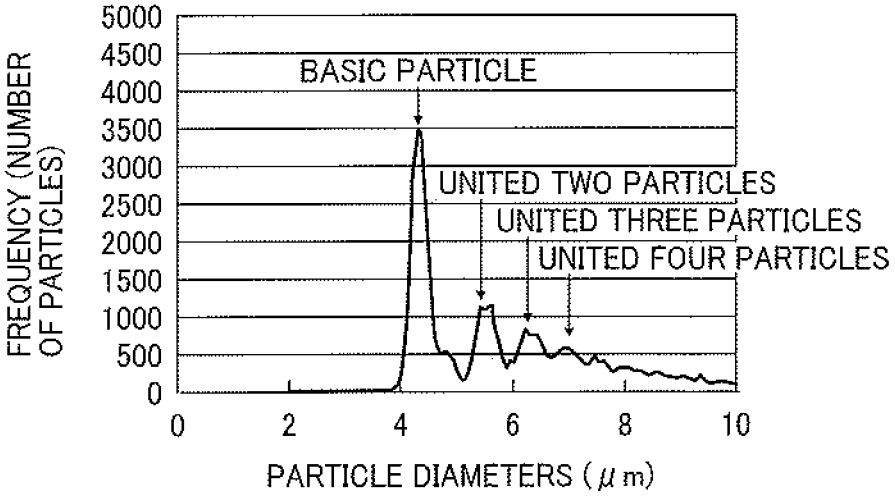
FIG. 9 is a graph showing the particle diameter distribution of a toner in a case where uniting of ejected droplets is caused.

When droplets of the toner composition liquid are continuously ejected from the droplet ejector 20, there is a case where two (or more) of the droplets 23 ejected from the nozzles 24 are united to form a united droplet. When such a united droplet is formed, the resultant toner particle has a large particle diameter, thereby widening the particle diameter distribution of the resultant toner particles. The mechanism of uniting of droplets is considered to be that before a first droplet ejected from the nozzle 24 is dried, the velocity of the first droplet is decreased due to viscosity resistance of air, and a second droplet following the first droplet is contacted with the first droplet, resulting in formation of a united droplet. The particle diameter distribution of a toner obtained by drying droplets including such a united particle is illustrated in FIG. 9. In this regard, since such a united droplet receives higher air resistance than a single droplet, the united droplet tends to be further united with another droplet, thereby forming united droplets in which three or more droplets are united. When droplets including such larger droplets are dried, the resultant toner has a wider particle diameter distribution.

Figure 10:
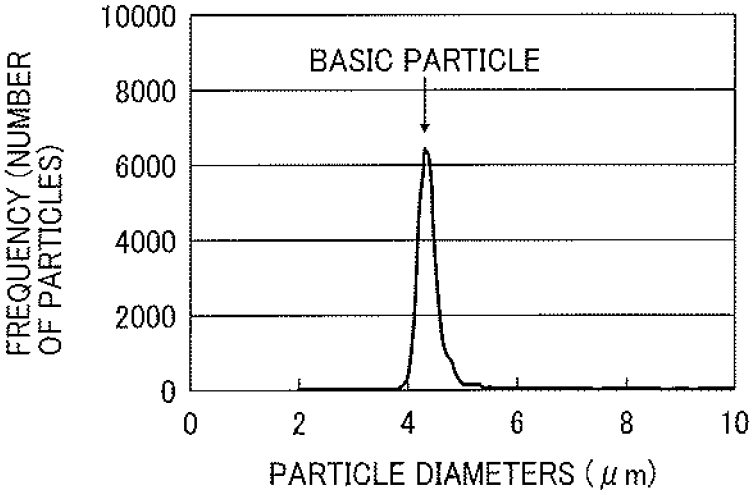
FIG. 10 is a graph showing the particle diameter distribution of a toner which is substantially constituted of basic particles.

FIG. 10 is a graph showing the particle diameter distribution of a toner obtained by drying droplets, which mainly include single droplets and which hardly include united droplets. In contrast, the toner obtained by drying droplets including united particles has such a particle diameter distribution as illustrated in FIG. 9. It is clear from FIG. 9 that the toner includes united particles such as united two, three, four or more particles. The particle diameter distribution of toner is determined using a flow particle image analyzer FPIA-3000 from Sysmex Corp.

Since it is hard to separate such united toner particles from each other even when a mechanical force is applied thereto, the united toner particles serve as large toner particles, and are not preferable. These united toner particles are typically formed when single droplets, which are dried to a certain extent, are contacted with each other. Specifically, a semi-dried single droplet, which is dried to a certain extent, is adhered to a wall of the chamber 62 or a feed pipe, and then another semi-dried single droplet is adhered thereto. After the united droplets are dried, the resultant united particles are separated from the chamber or the feed pipe, resulting in formation of united toner particles. In order to prevent formation of such united toner particles, it is preferable to quickly dry the ejected droplets or to control airflow in the toner production apparatus to prevent the ejected droplets from being adhered to a chamber or a feed pipe.

The particle diameter distribution of a particulate material is typically represented by a ratio (Dv/Dn) of the volume average particle diameter (Dv) to the number average particle diameter (Dn) of the particulate material. The ratio (Dv/Dn) is 1.0 at minimum. In this case, all the particles have the same particle diameter. As the ratio (Dv/Dn) increases, the particulate material has a wider particle diameter distribution. Toner prepared by a pulverization method typically has a ratio (Dv/Dn) of from 1.15 to 1.25, and toner prepared by a polymerization method typically has a ratio (Dv/Dn) of from 1.10 to 1.15. It was confirmed that when the toiler prepared by the toner production method of the present invention has a ratio (Dv/Dn) of not greater than 1.15, high quality toner images can be produced. The ratio (Dv/Dn) is more preferably not greater than 1.10.

In electrophotography, it is preferable to use a toner having as narrow particle diameter distribution as possible because the image developing process, image transferring process and image fixing process can be satisfactorily performed. Therefore, in order to stably produce high definition images, the Dv/Dn ratio of the toner is preferably not greater than 1.15, and more preferably not greater than 1.10.

In this toner production apparatus, in order to prevent formation of united droplets, the droplet ejector 20 (illustrated in FIG. 1) is arranged at a location between the chamber 62 and the entrance of the carrier air 31 in such a manner that the droplet ejection direction is substantially perpendicular to the flow direction of the carrier air 31.

The present inventors observe behavior of ejected droplets in a range of from the nozzles to a position apart from the nozzles by 2 mm using a laser shadowgraphy method, which has not been performed until now. As a result of the observation, it was found that uniting of droplets is caused even in such a near-nozzle range. In order to prevent uniting of droplets in such a near-nozzle range, the droplet ejector 20 is arranged so as to eject droplets in a direction perpendicular to the flow direction of the carrier air 31. As a result, it was confirmed that the number of united particles can be dramatically reduced by this method. Specifically, flight direction of the droplets ejected from the droplet ejector 20 in substantially the horizontal direction is changed by the carrier air 31, whose flow direction is perpendicular to the droplet ejection direction, so as to be the same as the flow direction of the carrier air 31. In this case, the droplet flight velocity can be maintained or increased, thereby making it possible to reduce chance of uniting of the droplets. Therefore, a toner having an extremely sharp particle diameter distribution can be provided.

The carrier air 31 preferably has such a velocity as to change the moving direction of the ejected droplets 23, and the velocity is preferably not less than 7 m/s, and more preferably from 8 to 15 m/s. When the velocity is lower than 7 m/s, there is a case where two adjacent droplets are contacted and united before the moving direction of the droplets is changed by the carrier air 31, thereby widening the particle diameter distribution of the resultant toner. When the velocity is higher than 16 m/s, there is a case where a fine droplet is released from an ejected droplet, resulting in formation of fine droplets, thereby widening the particle diameter distribution of the resultant toner.

The initial velocity ($V_0$) of the droplets 23 preferably satisfies the following relationship:

$$V_0 \geq 2d_0 \times f, \text{ and more preferably } V_0 > 3d_0 \times f,$$

wherein $d_0$ represents the diameter of the droplet just after the droplet is ejected, and f represents the drive frequency.

When $V_0 < 2d_0 \times f$, the distance between two adjacent droplets is shortened, and therefore two adjacent droplets are easily contacted and united before the moving direction of the droplets is changed by the carrier air 31. The diameter of the ejected droplet 23 and the ejection velocity can be adjusted by adjusting the diameter of the nozzles, the drive frequency, and the voltage applied to the vibrator 25.

Figure 11:
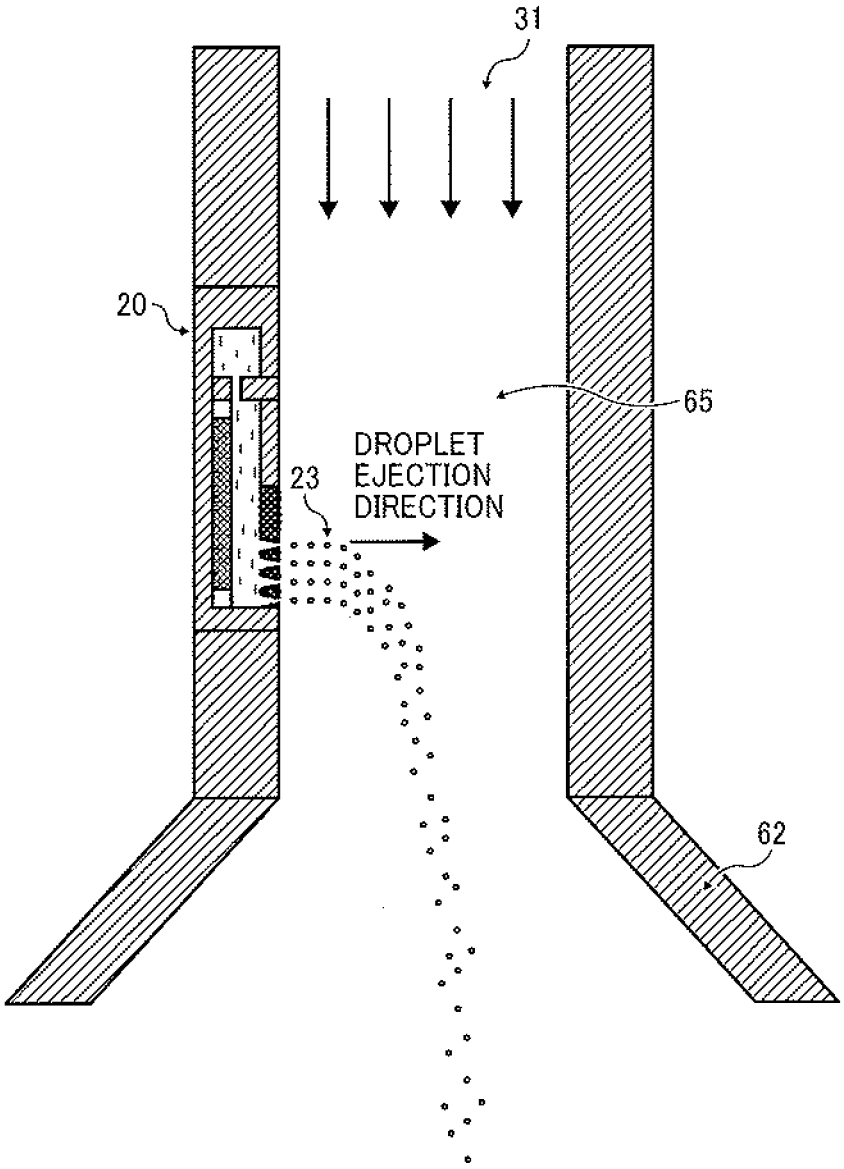
FIG. 11 is a schematic cross-sectional view illustrating the droplet ejector and the vicinity thereof in the toner production apparatus illustrated in FIG. 1.

As illustrated in FIG. 11, which is an enlarged view of FIG. 1, the droplet ejector 20 ejects droplets 23 of the toner composition liquid in substantially a horizontal direction, but the droplet ejection direction is not limited to the horizontal direction. The droplet ejection angle can be set to a proper angle. In order to generate the carrier air 31, a method in which a blower is provided on an upper portion of an entrance (airflow passage) 65 of the chamber 62 to feed air downward, or a method in which air is sucked from an exit 66 of the chamber 62, can be used. Specific examples of the toner collector 63 include cyclones, bag filters, and the like.

The airflow 31 is not particularly limited as long as the airflow 31 can prevent uniting of ejected droplets, and may laminar flow, swirling flow, or turbulent flow. In addition, the gaseous material constituting the carrier gas 31 is not particularly limited, and is typically air or an inert gas such as a nitrogen gas.

Since droplets of a toner composition liquid have a property such that after the droplets are dried, uniting of particles is not caused, the ejected droplets are preferably dried as quickly as possible. Therefore, the content of the vapor of the solvent, which is included in the droplets, in the chamber 62 is preferably as low as possible. In addition, the temperature of the carrier air 31 is preferably adjustable, and it is preferable that the temperature of the carrier air 31 is not changed during a toner production process. It is possible to provide a device for changing the conditions of the airflow 31 in the chamber 62. The airflow 31 may be used not only for preventing the ejected droplets from being united but also for preventing the ejected droplets from being adhered to an inner wall of the chamber 62.

When the content of a residual solvent remaining in the toner particles in the toner collector 63 is high, the toner particles may be subjected to a second drying treatment. Any known drying methods such as fluidized bed drying and vacuum drying can be used for the second drying treatment. When an organic solvent remains in the toner particles in a relatively large amount, not only toner properties such as high temperature preservability, fixability and charging property deteriorate, hut also a problem in that the organic solvent is evaporated when toner images are fixed, and therefore the vapor of the organic solvent adversely affects the users, the image forming apparatus, and the peripheral machines is caused. Therefore, it is preferable to sufficiently dry the toner particles.

Figure 12:
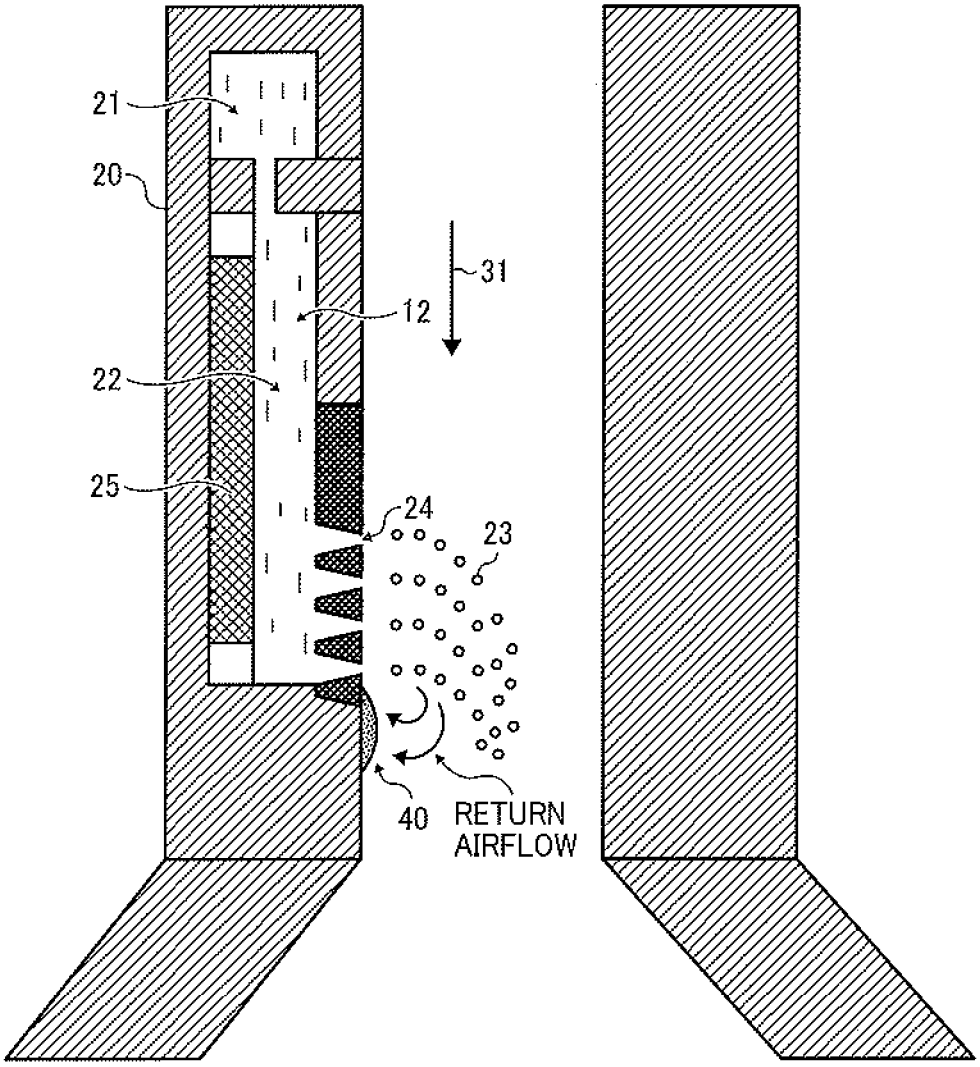
FIG. 12 is a schematic view for describing how the droplet ejector is contaminated with a toner composition liquid.

As illustrated in FIG. 12, when a toner composition liquid is ejected, there is a possibility that the toner composition liquid is exuded from the nozzles 24 or returns after being ejected, and the liquid is adhered to a surface portion of the nozzle plate of the droplet ejector 20 in the vicinity of the nozzles 24. When the toner composition liquid adhered to the nozzle plate is dried, a smudge (deposit) 40 is formed. The amount of the deposit 40 increases with time. When the deposit 40 becomes large, the nozzles 24 are clogged with the deposit 40. This phenomenon is actually observed in an experiment. When this phenomenon is caused, unstable ejection of the toner composition liquid is caused, and thereby the particle diameter distribution of the resultant toner is deteriorated (widened). When the toner production operation is continued without removing the deposit 40, the nozzles are clogged with the deposit, and ejection of the toner composition liquid is stopped. Therefore, it is preferable to periodically clean the nozzles and the nozzle plate.

The method for cleaning a droplet ejecting head (such as the above-mentioned droplet ejecting head) is a non-contact cleaning method using a non-contact cleaner and a cleaning liquid. By cleaning the nozzle plate using a non-contact method, chance of occurrence of problems caused by a contact method such as a wiping method used for cleaning inkjet recording heads such that the liquid repelling effect of the liquid repelling layer formed on the nozzle plate is deteriorated by wiping the nozzle plate, and the nozzle plate is degraded by wiping can be reduced.

Figure 13:
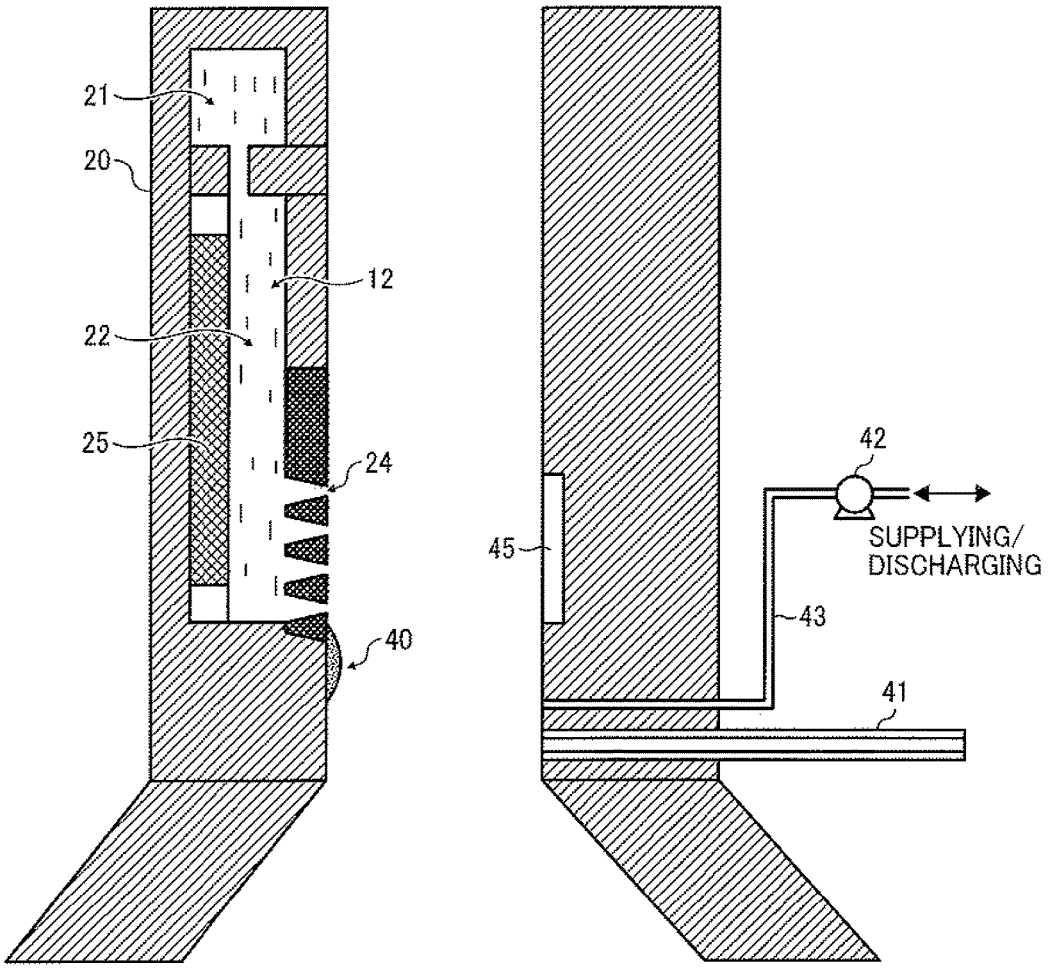
FIG. 13 is a schematic view illustrating a cleaner according to an embodiment.
Figure 14:
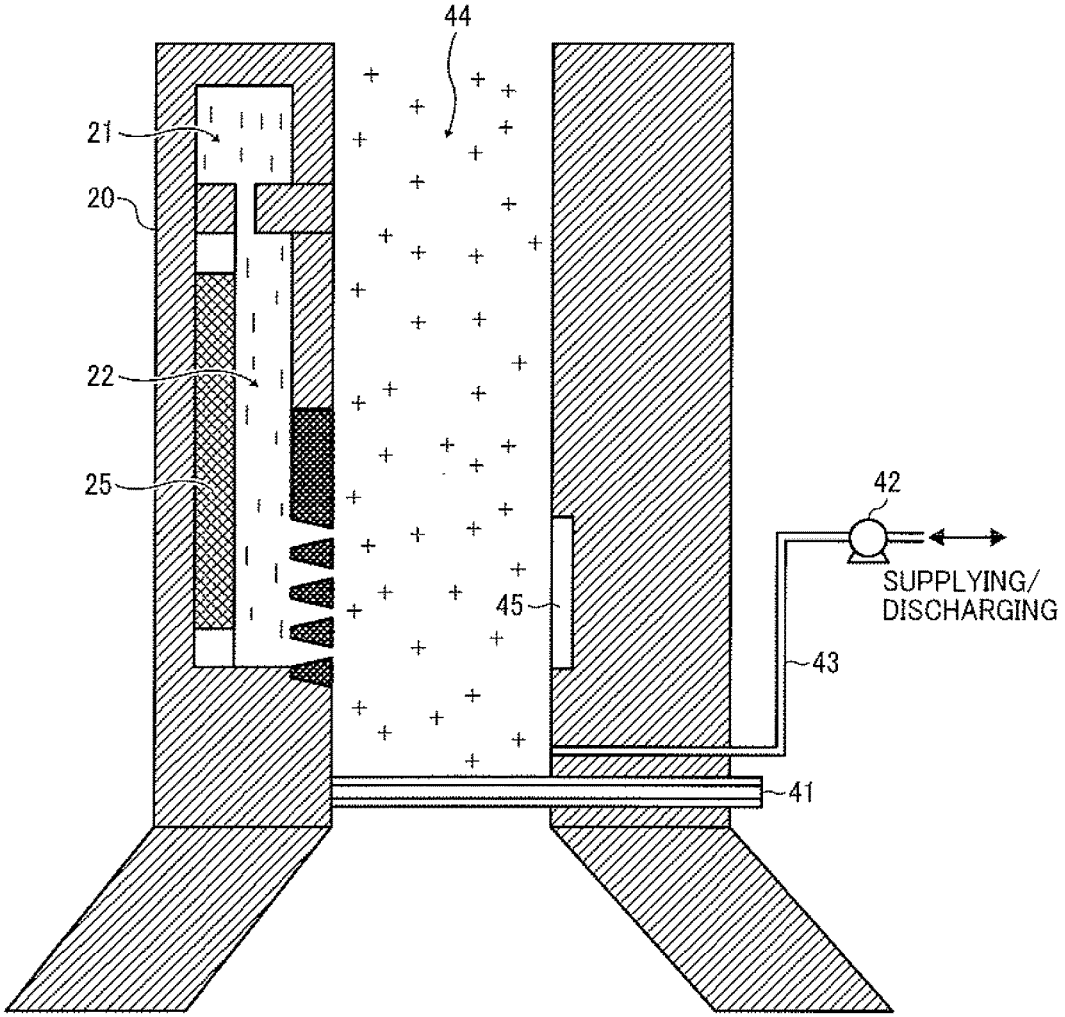
FIG. 14 is a schematic view for describing how the droplet ejecting head is cleaned.

The non-contact nozzle cleaning operation of the cleaning method of this disclosure is performed between toner particle preparation operations. The nozzle cleaning operation will be described by reference to a cleaner illustrated in FIG. 13. FIG. 13 is a schematic cross-sectional view illustrating a droplet ejector including a cleaner. The droplet ejector 20 has the deposit (smudge) 40 on a surface of the nozzle plate in the vicinity of the nozzles 24. In the cleaning operation, initially a space in the vicinity of the nozzles 24 in the airflow passage 65 is isolated by an isolating device to form a cleaning space while input of a driving signal for driving the droplet ejector is stopped, so that the cleaning space can be filled with a cleaning liquid. In the cleaner illustrated in FIG. 13, a shutter 41 serves as the isolating device (i.e., cleaning space forming device) to form the cleaning space, which is to be filled with a cleaning liquid (a first cleaning liquid 44), in the airflow passage 65 of the chamber 62. After the cleaning space is formed by moving the shutter 41 as illustrated in FIG. 14, a cleaning liquid 44 is fed from a tank (not shown) to the cleaning space by a cleaning liquid pump 42 through a pipe 43 to fill the cleaning space with the cleaning liquid 44. The cleaning liquid pump serves as a first cleaning liquid supplying device. Next, the cleaning liquid 44 is vibrated by a cleaning liquid vibrator 45 to dissolve the deposit 40 or to separate the deposit 40 from the nozzle plate, resulting in cleaning of the nozzle surface. After vibrating the cleaning liquid 44 (i.e., after the deposit 40 is removed from the nozzle surface), the cleaning liquid is discharged from the cleaning space by the cleaning liquid pump 42 through the pipe 43, and the shutter 41 is returned to the original position. Thus, the cleaning operation is completed.

The deposit (smudge) 40 to be removed by the non-contact nozzle cleaning method of this disclosure is a dried material of the toner composition liquid formed on the nozzle plate and the vicinity of the nozzles, and the deposits are present over a relatively wide range. In the cleaning method of this disclosure, a space in the vicinity of the nozzles 24 in the airflow passage 65 is isolated by an isolating device to form a cleaning space to be filled with the cleaning liquid. Therefore, the area of the droplet ejector 20 contacted with the cleaning liquid 44 can be cleaned. Since the nozzle surface is subjected to a liquid repelling treatment as mentioned above to enhance droplet ejection stability, the nozzle surface can be easily cleaned by this non-contact cleaning operation because adhesion between the deposition and the nozzle surface is relatively low. Therefore, it is preferable that the inner surface of the chamber 62, which is used for forming the cleaning space, is also subjected to a liquid repelling treatment so that the inner surface can be easily cleaned by the cleaning operation. The liquid repelling treatment mentioned above for use as the liquid repelling treatment for the nozzles can be used for the inner surface of the chamber 62, but the liquid repelling treatment is not limited thereto. FIG. 16A illustrates an inner surface of the chamber 62 on which the $SiO_2$ layer 28 and the liquid repelling layer 29 are formed.

The first cleaning liquid 44 (illustrated in FIG. 14) to be contained in the cleaning space in the chamber 62 is preferably a solvent which can dissolve the toner composition to enhance the cleaning effect. In addition, it is preferable that the solvent does not cause a chemical reaction with the toner composition liquid and the cleaning liquid supplied to the droplet ejector 20 or agglomeration of the dispersed components in the toner composition liquid, or does not change the property or formulation of the toner composition liquid. Therefore, it is preferable that the solvent used for the toner composition liquid, the cleaning liquid supplied to the droplet ejector 20, and the cleaning liquid to be contained in the cleaning space are the same kind of solvent. However, the solvent used for the cleaning liquid is not limited thereto. For example, other solvents can be used for the cleaning liquid as long as the above-mentioned conditions are satisfied. Specifically, in Examples mentioned below, ethyl acetate is used as the solvent of the toner composition liquid. In this case, it is confirmed that solvents such as ethyl acetate, acetone, methyl ethyl ketone (MEK), and tetrahydrofuran (THE) can be used for the cleaning liquid.

In this cleaning method, by increasing the temperature of the cleaning liquid, the cleaning effect can be further enhanced. In this regard, the higher the temperature of the cleaning liquid, the better the cleaning effect. However, when the temperature is higher than the boiling point of the solvent used for the toner composition liquid, a problem in that the solvent in the toner composition liquid evaporates, thereby making it impossible to eject droplets of the toner composition liquid due to bubbles formed in the toner composition liquid by evaporation of the solvent is caused. In addition, when the temperature is higher than the melting point of a wax dispersed in the toner composition liquid, the dispersed wax particles are partially melted, resulting in change of the properties of the toner composition liquid, thereby adversely affecting the ejection stability of the toner composition liquid. Therefore, the temperature of the cleaning liquid preferably falls in a range in which the properties of the toner composition liquid do not deteriorate.

The isolating device to form a cleaning space in the vicinity of the nozzles is not particularly limited as long as the purpose (i.e., containing a cleaning liquid in the cleaning space without leaking) can be achieved. In the cleaner illustrated in FIGS. 13 and 14, the isolating device is a slidable valve, but rotary valves, ball valves, and other valves can also be used. In addition, in the cleaner illustrated in FIGS. 13 and 14, the cleaning space is formed by separating a part of the airflow passage using the shutter 41. When the droplet ejector is set horizontally, a method in which two shutters are provided at the entrance and exit of the airflow passage to form a cleaning space can be used.

When the top surface of the shutter 41 preferably serves as a part of the inner wall of the chamber 62 (i.e., the top surface is located on the same plane as the inner wall of the chamber) when the shutter is opened (i.e., the cleaning operation is not performed) so that the airflow 31 is not turbulent when the toner composition liquid 12 is ejected from the nozzles 24.

The cleaning liquid vibrator 45 is not particularly limited as long as the vibrator can operate (vibrate) at a predetermined frequency. It is preferable to provide an amplifier such as horns on the piezoelectric material. Piezoelectric ceramics such as lead zirconate titanate (PZT) can be preferably used for the piezoelectric material. In addition, popular Langevin ultrasonic vibrators can also be used. The drive frequency is preferably from 10 to 100 kHz, and it is possible to use a combination of plural frequencies. In addition, it is possible to change the drive frequency with time in a cleaning operation to change the cleaning efficiency. The cleaning liquid vibrator 45 is set so as to be a part of the wall forming the cleaning space, and preferably faces the nozzles 24. Further, it is possible to vibrate the cleaning liquid 44 with the vibrator 25 of the droplet ejector 20 via the toner composition liquid 12. Namely, by switching the drive frequency for the vibrator 25 to the drive frequency for cleaning, the toner composition liquid is strongly vibrated to transmit the vibration to the cleaning liquid 44 contacted with the toner composition liquid 12 at the nozzles 24.

Next, an effective example of the cleaning method will be described by reference to a flowchart in FIG. 15. In this regard, the cleaning method is determined depending on the degree or property of the smudges (such as deposit 40), and one or more steps in FIG. 15 can be omitted if unnecessary.

Initially, the reason for non-ejection of droplets from nozzles will be described. When droplet ejection from nozzles is continuously performed over a long period of time, there are some nozzles from which droplets are unstably ejected or droplets are not ejected for any reason. The reason therefor is considered to be clogging of the nozzles with bubbles mixed into the particulate material composition liquid (such as toner composition liquid), bubbles formed in the particulate material composition liquid due to cavitation caused by vibration, solid impurities mixed into the particulate material composition liquid, aggregation of a component dispersed in the particulate material composition liquid, and precipitation of a component dispersed in the particulate material composition liquid; or enlargement of the deposit 40. When such unstable ejection or non-ejection is caused, flow of the particulate material composition liquid in the droplet ejector 20, and the internal pressure of the droplet ejector are changed, and therefore ejection of droplets from other nozzles is changed because the airflow 31 is also changed thereby. Therefore, the number of unstably ejecting or non-ejecting nozzles is increased exponentially. This is actually observed by an experiment.

In addition, it is also confirmed by an experiment that uneven ejection allows the airflow 31 to be turbulent, and thereby problems in that the ejected droplets are united, and adhered to the wall of the drying and collecting unit 60 are often caused. Therefore, in order to produce a particulate material having a sharp particle diameter distribution with a high degree of productivity, it is preferable to maintain the initial high ejection rate while rapidly taking countermeasure to unstable ejection and non-ejection. The countermeasure is quick cleaning.

Figure 15:
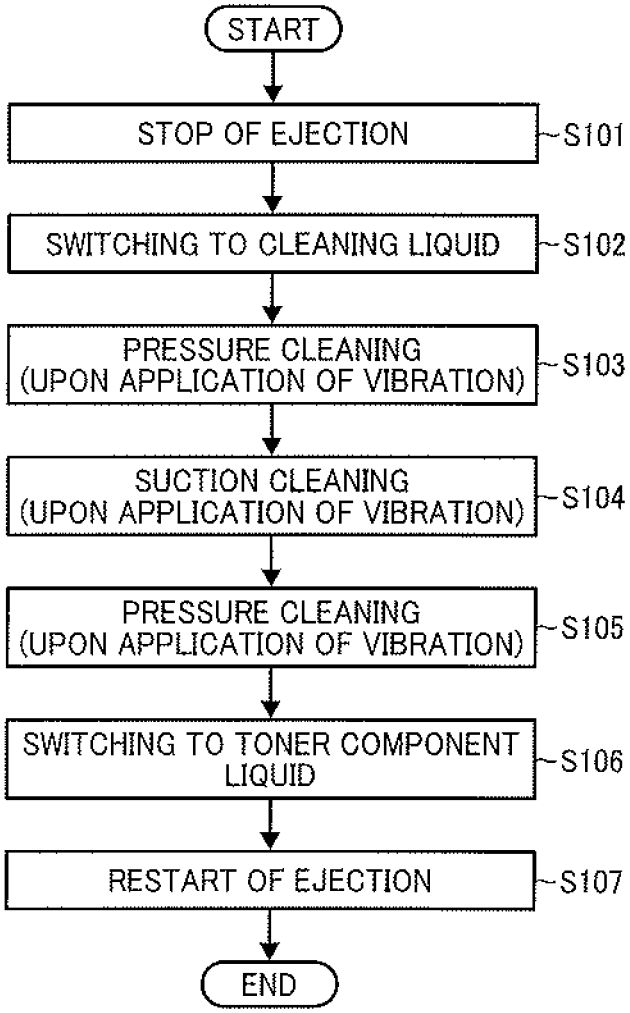
FIG. 15 is a flowchart of a droplet ejecting head cleaning operation.

Referring to FIG. 15, after stopping ejection of droplets of a toner composition liquid (step S101), the toner composition liquid is switched to a second cleaning liquid (step S102), so that pressure cleaning can be performed (step S103) without forming bubbles of a gas in the droplet ejecting head. Since no gas enters into the droplet ejecting head, the cleaning operation can be performed securely while preventing the toner composition liquid from drying. Therefore, occurrence of problems in that the chamber 22 is deformed, and the viscosity of the toner composition liquid increases, thereby deteriorating the droplet ejection performance of the droplet ejecting head can be prevented.

In the switching step in step S101, the switching device 17 changes a liquid supply passage of from the toner composition liquid container 13 to the droplet ejector 20 to another liquid supply passage of from the cleaning liquid container 53 to the droplet ejector 20. After the valve 57 is opened, the second cleaning liquid 52 in the cleaning liquid container 53 is supplied to the droplet ejector 20 by the second cleaning liquid supplying device 56. Therefore, the toner composition liquid in the droplet ejector 20 and the supply tube 18 is fed to the waste liquid container 50 while replaced with the second cleaning liquid 52. At the same time, the shutter 41 is closed to form a cleaning space to be filled with the first cleaning liquid 44, which is the same as or different from the second cleaning liquid supplied to the droplet ejector 20, in the vicinity of the droplet ejector, and the first cleaning liquid 44 is supplied from a cleaning liquid tank (not shown) to the cleaning space by the cleaning liquid pump 42 through the pipe 43, thereby filling the cleaning space with the first cleaning liquid 44. Thereafter, the first cleaning liquid 44 is vibrated by the vibrator 45 to dissolve the smudges (such as deposit 40) or separate the smudges from nozzles and the nozzle plate.

In the pressure cleaning process in step S103, the valve 57 is closed in addition to the switching operation (step S102), and the second cleaning liquid 52 is continuously supplied to the droplet ejector 20, thereby increasing the pressure in the supply tube 18 which is measured with the pressure gauge 19. In this regard, by increasing the pressure (liquid feeding pressure) applied to the second cleaning liquid 52 by the second cleaning liquid supplying device 56 to feed the second cleaning liquid, the second cleaning liquid is discharged from the nozzles 24, thereby removing a dried material of the toner composition liquid covering the nozzles while removing bubbles and foreign solid materials, which are present in the droplet ejecting head and which cause the nozzle clogging problem, from the head.

The liquid feeding pressure can be measured by the pressure gauge 19 to be controlled. The proper liquid feeding pressure for the cleaning operation is determined depending on the diameter of the nozzles 24, and is preferably from 5 to 50 kPa, and more preferably from 20 to 40 kPa. When the liquid feeding pressure is lower than 5 kPa, the cleaning operation tends to be insufficiently performed. In contrast, when the liquid feeding pressure is higher than 50 kPa, a problem in that the droplet ejector 20 is damaged tends to be caused while excessively consuming the cleaning liquid.

Next, a suction cleaning process is performed (step S104). In step S104, the nozzle plate of the droplet ejecting head is dipped in the cleaning liquid while stopping feeding of the cleaning liquid by the second cleaning liquid supplying device 56, operating the discharging device 59, and opening the valve 57 so that the pressure in the discharge tube 58 is a negative pressure of −10 kPa, thereby flowing the cleaning liquid (first cleaning liquid) from the cleaning space to the droplet ejecting head (i.e., flowing the cleaning liquid in a direction opposite to that in the pressure cleaning operation mentioned above). In this case, solid materials which are present in the droplet ejecting head and with which the nozzles are clogged can be removed. In addition, the toner composition liquid and the deposit 40 adhered to the outer surface of the nozzles can also be removed. Similarly to the pressure cleaning process, it is preferable in this suction cleaning process to apply vibration to the first cleaning liquid 44 in the cleaning space with the vibrator 45 to produce good cleaning effect while shortening the cleaning time and increasing the productivity of the particulate material.

The suction pressure of sucking the cleaning liquid can be measured by the pressure gauge 19 to be controlled. The proper suction pressure is determined depending on the diameter of the nozzles 24, and is preferably from −5 to −50 kPa, and more preferably from −10 to −20 kPa. When the suction pressure is lower than −5 kPa (in absolute value), the cleaning operation tends to be insufficiently performed. When the suction pressure is higher than −50 kPa (in absolute value), there is a possibility that that solid impurities present outside the nozzles are adhered to the outer surface of the nozzles by the flow of the cleaning liquid, thereby clogging the nozzles with the impurities, and in addition bubbles are formed in the droplet ejecting head due to cavitation caused by reduction of pressure. Therefore, the suction pressure is preferably not higher than −50 kPa (in absolute value).

When the outside of the droplet ejector 20 is seriously contaminated with the toner composition liquid and the dried material thereof, it is preferable that before performing the suction cleaning process, the cleaning liquid in the vicinity of the droplet ejector 20 is discharged by the pump 42 and then a new first cleaning liquid is supplied to the cleaning space by the pump 42 so that the cleaning space is filled with the first cleaning liquid. This cleaning liquid changing operation may be performed plural times before starting the suction cleaning process.

In order to remove dust, which covers the nozzles 24 from outside and with which the nozzles are clogged, and bubbles present in the droplet ejecting head, a second pressure cleaning process, which is the same as the first pressure cleaning process (step S103) is performed (step S105). After the second pressure cleaning process, vibration of the first cleaning liquid 44 using the vibrator 45 is stopped, and then the first cleaning liquid 44 is discharged by the pump 42 through the pipe 43, followed by opening of the shutter 41.

Finally, switching from the second cleaning liquid to the toner composition liquid is performed by the switching device 17 without allowing the droplet ejecting head to be empty (step S106), and then the droplet ejecting operation is restarted (step S107). Thus, bubbles are not included in the droplet ejecting head, and therefore droplets of the toner composition liquid can be stably ejected at a high droplet ejection rate even in the start of the droplet ejecting operation. In addition, this high droplet ejection rate can be maintained over a long period of time.

It is confirmed by the present inventors that when a driving signal is applied to the vibrator 25 of the droplet ejector 20 in the cleaning process, in which the first cleaning liquid 44 is contacted with the droplet ejecting head while vibrating the cleaning liquid with the vibrator 45, better cleaning effects can be produced. In this regard, the driving signal may be the same as the signal used for recording images, or a driving signal having a lower voltage than such a recording signal. It is confirmed that by using this method, the ejection stability of the droplet ejecting head can be dramatically enhanced.

Since there is a possibility that droplets ejected just after the cleaning operation have a lower solid content due to mixing of the cleaning liquid, it is possible that the resultant particulate material (hereinafter referred to as toner) has a particle diameter smaller than the targeted particle diameter. Therefore, it is preferable that such toner particles are not collected, or are collected in another container, followed by measuring the particle diameter thereof. If it is confirmed that the collected toner has no problem in quality, the toner can be used as the product.

In the toner production apparatus mentioned above, a droplet ejection method in which pressure distribution is formed using a liquid column resonance standing wave to eject droplets of a toner composition liquid from nozzles is used. However, the droplet ejection method is not limited thereto.

Next, toner will be described as an example of the particulate material to be produced by the particulate material production apparatus mentioned above.

By using the particulate material production apparatus of this disclosure, a toner having a sharp particle diameter distribution, i.e., a toner like a monodisperse toner, can be produced.

Specifically, the toner preferably has a particle diameter distribution (i.e., Dv/Dn ratio) of from 1.00 to 1.15, and more preferably from 1.00 to 1.05. The volume average particle diameter (Dv) of the toner preferably falls in a range of from 1 μm to 20 μm, and more preferably from 3 μm to 10 μm.

Next, the toner components constituting the toner will be described. Initially, the toner composition liquid in which the toner components are dissolved or dispersed in a solvent will be described.

Any known toner components for use in conventional electrophotographic toner can be used for the toner to be produced by the particulate material production apparatus of this disclosure. Specifically, the toner components can include a binder resin, a colorant, a release agent (such as waxes), and additives such as charge controlling agents. The toner composition liquid is typically prepared by a method including dissolving a binder resin such as styrene acrylic resins, polyester resins, polyol resins, and epoxy resins in a solvent, and dispersing a colorant in the resin solution while dispersing or dissolving therein a release agent, and optional additives. The thus prepared toner composition liquid is ejected from nozzles as droplets, and the droplets are dried, by using the toner production apparatus mentioned above to produce particles of the toner.

The toner includes a binder resin, a colorant, and a release agent (such as waxes) as main components, and optionally includes other components such as charge controlling agents.

The binder resin is not particularly limited, and any known resins for use in conventional toner can be used. Specific examples thereof include homopolymers and copolymers of vinyl compounds such as styrene compounds, acrylic compounds, and methacrylic compounds; polyester resins, polyol resins, phenolic resins, silicone resins, polyurethane resins, polyamide resins, furan resins, epoxy resins, xylene resins, terpene resins, coumarone-indene resins, polycarbonate resins, and petroleum resins.

When a styrene-acrylic resin is used as a binder resin, the resin preferably has a molecular weight distribution such that when tetrahydrofuran(THF)-soluble components of the resin are subjected to gel permeation chromatography (GPC) to obtain a molecular weight distribution curve, the curve has at least one peak in a molecular weight range of from 3,000 to 50,000 (number average molecular weight) while having another peak at a molecular weight of not less than 100,000. By using such a binder resin, a good combination of fixability, offset resistance and preservability can be imparted to the toner. In addition, the resin preferably has a property such that the THE-soluble components thereof preferably include components having a molecular weight of not greater than 100,000 in an amount of from 50 to 90%. In addition, the resin preferably has a main peak in a molecular weight range of from 5,000 to 30,000, and more preferably from 5,000 to 20,000.

When a vinyl polymer (such as styrene-acrylic resins) is used as a binder resin, the vinyl polymer preferably has an acid value of from 0.1 to 100 mgKOH/g, more preferably from 0.1 to 70 mgKOH/g, and even more preferably from 0.1 to 50 mgKOH/g.

When a polyester resin is used as a binder resin, the resin preferably has a molecular weight distribution such that when tetrahydrofuran(THF)-soluble components of the resin are subjected to gel permeation chromatography (GPC) to obtain a molecular weight distribution curve, the curve has at least one peak in a molecular weight range of from 3,000 to 50,000 so that a good combination of fixability and offset resistance can be imparted to the resultant toner. In addition, the resin preferably has a property such that the THF-soluble components thereof preferably include components having a molecular weight of not greater than 100,000 in an amount of from 60 to 100%. In addition, the resin preferably has at least one main peak in a molecular weight range of from 5,000 to 20,000.

When a polyester resin is used as a binder resin, the resin preferably has an acid value of from 0.1 to 100 mgKOH/g, more preferably from 0.1 to 70 mgKOH/g, and even more preferably from 0.1 to 50 mgKOH/g.

In this disclosure, the molecular weight distribution of a resin is measured by gel permeation chromatography (GPC).

In addition, when a vinyl polymer and a polyester resin are used as binder resins, one of the resins preferably has a unit reactive with the other (i.e., the polyester resin or the vinyl polymer). Specific examples of the monomers for use in forming a unit, which included in a polyester resin and is reactive with a vinyl polymer, include unsaturated dicarboxylic acids or anhydrides such as phthalic acid, maleic acid, citraconic acid, and itaconic acid. Specific examples of the monomers for use in forming a unit, which is included in a vinyl polymer and is reactive with a polyester resin, include monomers having a carboxyl group, or a hydroxyl group, such as (meth)acrylic acid and esters thereof.

When a combination of a polyester resin, a vinyl polymer, and another resin is used as the binder resin, the content of resins having an acid value of from 0.1 to 50 mgKOH/g is preferably not less than 60% by weight based on the total weight of the binder resin.

The acid value of a binder resin component is determined by the method described in JIS K-0070, which is as follows.

(1) At first, about 0.5 to 2.0 g of a sample (a binder resin), which is precisely measured. In this regard, when the sample includes other materials such as additives, the materials are removed from the sample, or the acid values and Contents of the materials other than the binder resin and the crosslinked binder resin are previously determined. For example, when the acid value of the binder resin component included in a toner, which further includes a colorant and additives such as magnetic materials, is determined, the acid values and the content of the colorant and the additives are previously determined and then the acid value of the toner is determined. The acid value of the binder resin component is calculated from these acid value data and content data.

(2) The sample is mixed with 150 ml of a mixture solvent of toluene and ethanol (mixed in a volume ratio of 4:1) in a 300-ml beaker to be dissolved.

(3) The thus prepared solution is subjected to a potentiometric titration using a 0.1 mol/L ethanol solution of potassium hydroxide (KOH).

The acid value (AV) of the sample is calculated by the following equation.

$$AV(mgKOH/g)=[(S-B)\times f\times 5.61]/W,$$

wherein S represents the amount of KOH consumed in the titration, B represents the amount of KOH consumed in the titration when a blank (i.e., a toluene/ethanol mixture solvent) is subjected to the titration, f represents the factor of N/10 potassium hydroxide, and W represents the precise weight of the sample.

Each of the binder resin of the toner and the toner composition preferably has a glass transition temperature (Tg) of from 35 to 80° C., and more preferably from 40 to 75° C. In this case, the toner has good preservability. When the Tg is lower than 35° C., the toner tends to deteriorate when being preserved under high temperature conditions while causing an offset problem in a fixing process. In contrast, when the Tg is higher than 80° C., the fixability of the toner tends to deteriorate.

The following magnetic materials can be used for the toner to be prepared by the particulate material production apparatus of this disclosure.

(1) Magnetic iron oxides such as magnetite, maghemite, and ferrite, and iron oxides including another metal oxide;

(2) Metals such as iron, cobalt, and nickel, and metal alloys of these metals with another metal such as aluminum, copper, lead, magnesium, tin, zinc, antimony, beryllium, bismuth, cadmium, calcium, manganese, selenium, titanium, tungsten, and vanadium; and (3) Mixtures of the materials mentioned above in paragraphs (1) and (2).

Specific examples of the magnetic materials include $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O_{19}$, $NiFe_2O_4$, $NdFe_2O_3$, $BaFe_{12}O_{19}$, $MgFe_2O_4$, $MnFe_2O_4$, $LaFeO_3$, iron powders, cobalt powders, and nickel powders. These materials can be used alone or in combination. Among these materials, $Fe_3O_4$, and $\gamma$-$Fe_2O_3$ are preferable.

In addition, magnetic iron oxides including another element (such as magnetite, maghemite, and ferrite), and mixtures thereof can also be used as the magnetic material. Specific examples of such an element include lithium, beryllium, boron, magnesium, aluminum, silicon, phosphorous, germanium, zirconium, tin, sulfur, calcium, scandium, titanium, vanadium, chromium, manganese, cobalt, nickel, copper, zinc, and gallium. Among these elements, magnesium, aluminum, silicon, phosphorous, and zirconium are preferable. The element can be included in an iron oxide in one of the flowing manners:

(1) The element is incorporated in an iron oxide crystal lattice;

(2) The element is included in an iron oxide in a font of an oxide thereof; and (3) The element is present on an iron oxide in a form of an oxide or hydroxide thereof.

Among these magnetic materials, the materials mentioned above in paragraph (2) are preferable.

These magnetic materials including another element can be prepared by a method including mixing a salt of the element with raw materials of a magnetic material, and then preparing the magnetic material while controlling the pH, so that the element can be incorporated in particles of the magnetic material. Alternatively, by mixing particles of a magnetic, material with a salt of the element before or after controlling the pH, the element can be precipitated on the surface of the magnetic particles.

The added amount of such a magnetic, material in the toner is from 10 to 200 parts by weight, and preferably from 20 to 150 parts by weight, based on 100 parts by weight of the binder resin component included in the toner. The number average particle diameter of such a magnetic material included in the toner is preferably from 0.1 μm to 2 μm, and more preferably from 0.1 μm to 0.5 μm. The number average particle diameter of a magnetic material can be determined by analyzing a photograph of the magnetic material, which is taken by a transmission electron microscope, using a digitizer.

The magnetic material included in the toner preferably has a coercivity of from 20 to 150 Oe (159.2 to 11940 A/m), a saturation magnetization of from 50 to 200 emu/g (0.05 to 0.2 $A \cdot m^2/g$), and a remanent magnetization of from 2 to 20 emu/g (0.002 to 0.02 $A \cdot m^2/g$) Such a magnetic material can be used as a colorant.

The colorant included in the toner is not particularly limited, and any known pigments and dyes for use in toner can be used as the colorant.

The content of a colorant in the toner is preferably from 1 to 15% by weight, and more preferably from 3 to 10% by weight.

A master batch which is a combination of a colorant and a resin can be used as the colorant of the toner. The master batch is a material such that a pigment is preliminarily dispersed in a resin. If a pigment can be dispersed in a toner composition, such a master batch is not necessarily used. The master batch is typically prepared by applying a high shearing force to a mixture of a pigment and a resin to satisfactorily disperse the pigment in the resin. One or more of any known resins can be used as the resin used for forming the master batch or the resin to be kneaded together with a master batch.

The added amount of a master batch in the toner is preferably from 0.1 to 20 parts by weight based on 100 parts by weight of the binder resin included in the toner.

Resins for use in the master batch preferably have an acid value of not greater than 30 mgKOH/g (more preferably not greater than 20 mgKOH/g), and an amine value of from 1 to 100 mgKOH/g (more preferably 10 to 50 mgKOH/g) so that a colorant can be satisfactorily dispersed in the resultant master batch. When the acid value is greater than 30 mgKOH/g, the charging ability of the resultant toner tends to deteriorate under high humidity conditions, and the pigment dispersing ability of the resins tends to deteriorate. When the amine value is less than 1 mgKOH/g or greater than 100 mgKOH/g, the pigment dispersing ability of the resins tends to deteriorate. The acid value can be determined by the method described in JIS K0070, and the amine value can be determined by the method described in JIS K7237.

In order to satisfactorily disperse a colorant in a binder resin in a master batch production process, a dispersant can be used. It is preferable for such a dispersant to have good compatibility with the binder resin used to satisfactorily disperse a colorant. Any known dispersants can be used. Specific examples of marketed products of such a dispersant include AJISPER PB821 and AJISPER PB822, which are from Ajinomoto Fine-Techno Co., Ltd.; DISPERBYK 2001 from BYK Chemie GmbH; and EFKA 4010 from BASF.

The added amount of a dispersant is preferably from 1 to 200 parts by weight, and more preferably from 5 to 80 parts by weight, based on 100 parts by weight of the colorant included in the master batch. When the added mount is less than 1 part by weight, a problem in that a colorant is not satisfactorily dispersed is often caused. When the added amount is greater than 200 parts by weight, a problem in that the charge property of the toner deteriorates is often caused.

The dispersants mentioned above preferably has a weight average molecular weight property such that a main peak has a maximum value in a range of from 500 to 100,000, and preferably from 3,000 to 100,000 from the viewpoint of pigment dispersing ability, wherein the weight average molecular weight is determined by gel permeation chromatography (GPC) using a styrene-conversion method. The weight average molecular weight is more preferably from 5,000 to 50,000, and even more preferably from 5,000 to 30,000. When the weight average molecular weight is less than 500, the dispersant has too high a polarity, and therefore it often becomes difficult to satisfactorily disperse a colorant. When the molecular weight is greater than 100,000, the affinity of the dispersant for a solvent increases, and therefore it often becomes difficult to satisfactorily disperse a colorant.

The toner composition liquid for use in the toner preparation apparatus includes a wax together with a binder resin and a colorant.

The wax is not particularly limited, and any known waxes can be used for the wax of the toner while properly selected. Specific examples thereof include aliphatic hydrocarbon waxes such as low molecular weight polyethylene, low molecular weight polypropylene, polyolefin waxes, microcrystalline waxes, paraffin waxes, and Sasol waxes; oxidized materials of aliphatic hydrocarbon waxes or block copolymers of the materials such as oxidized polyethylene waxes; vegetable waxes such as candelilla waxes, carnauba waxes, Japan waxes, and jojoba waxes; animal waxes such as bees waxes, lanolin and whale waxes; mineral waxes such as ozocerite, ceresine and petrolatum; waxes including fatty acid esters as main components such as montanic acid ester waxes, and caster waxes; and partially or entirely deoxidized fatty acid esters such as deoxidized carnauba waxes.

The wax to be included in the toner preferably has a melting point of form 70 to 140° C., and more preferably from 70 to 120° C., so that the fixability of the toner and the offset resistance thereof are balanced. When the melting point is lower than 70° C., it is hard to impart good blocking resistance to the toner. When the melting point is higher than 140° C., it is hard to impart good offset resistance to the toner.

The total amount of waxes in the toner is preferably from 0.2 to 20 parts by weight, and more preferably from 0.5 to 10 parts by weight, based on 100 parts by weight of the binder resin included in the toner.

The melting point of a wax is defined as the temperature at which the maximum endothermic peak of the DSC (differential scanning calorimetry) curve of the wax has a peak top.

The DSC measuring instrument used for measuring the melting point of a wax or a toner is preferably a high-precision internally-heated input compensation type differential scanning calorimeter. ASTM D3418-82 is used as the measuring method. The DSC curve used for determining the melting point is obtained by heating a sample at a temperature rising speed of 10° C./min after the sample is preliminarily heated and then cooled to delete history from the sample.

Other additives can be added to the toner if desired in order to protect an electrostatic latent image bearing member and a carrier, which are used for image forming apparatus for which the toner is used, to enhance the cleaning property and the fixing rate of the toner, and to adjust the thermal property, the electric property, the physical property, the resistance, and the softening point of the toner. Specific examples thereof include various metal soaps, fluorine-containing surfactants, dioctyl phthalate, electroconductivity imparting agents such as tin oxide, zinc oxide, carbon black and antimony oxide, and particulate inorganic materials such as titanium oxide, aluminum oxide, and alumina. The particulate inorganic materials may be hydrophobized if desired. In addition, lubricants such as polytetrafluoroethylene, zinc stearate and polyvinylidene fluoride, abrasives such as cesium oxide, silicon carbide and strontium titanate, and caking preventing agents can also be added in a small amount. Further, small amounts of white particulate materials and black particulate materials, which have a charge having a polarity opposite to that of the toner, can be used as development improving agents.

It is also preferable that the surfaces of these additives are treated with one or more of treatment agents such as silicone varnishes, various modified silicone varnishes, silicone oils, various modified silicone oils, si lane coupling agents, silane coupling agents having a functional group, and other organic Silicon compounds to control the charge quantity of the toner.

Particulate inorganic materials are preferably used as the additives (i.e. external additives). Specific examples thereof include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. The particulate inorganic materials for use in the toner preferably have an average primary particle diameter of from 5 nm to 2 μm, and more preferably from 5 nm to 500 nm.

In addition, the particulate inorganic materials preferably have a BET specific surface area of from 20 to 500 $m^2/g$. The content of a particulate inorganic material in the toner is preferably from 0.01 to 5% by weight, and more preferably from 0.01 to 2.0% by weight, based on the weight of the toner.

Further, particulate polymers such as polystyrene, polymethacrylates, and polyacrylate copolymers, which are prepared by a polymerization method such as soap-free emulsion polymerization methods, suspension polymerization methods and dispersion polymerization methods; and particulate polymers such as silicone, benzoguanamine resins, and nylon resins, which are prepared by a polymerization method such as polycondensation methods; and particles of a thermosetting resin, can also be used as external additives.

These external additives can be treated with a surface treatment agent to enhance the hydrophobicity thereof, thereby preventing deterioration of the additives themselves under high humidity conditions. Specific examples of such a surface treatment agent include silane coupling agents, silylating agents, silane coupling agents having a fluorinated alkyl group, organic titanate coupling agents, aluminum coupling agents, silicone oils, and modified silicone oils.

In addition, the toner preferably includes a deniability improving agent which can impart good cleaning property to the toner such that particles of the toner remaining on the surface of an image bearing member such as a photoreceptor and an intermediate transfer medium even after a toner image is transferred therefrom can be easily removed therefrom. Specific examples of such a cleanability improving agent include fatty acids and their metal salts such as stearic acid, zinc stearate, and calcium stearate; and particulate polymers such as polymethyl methacrylate and polystyrene, which are manufactured by a method such as soap-free emulsion polymerization methods. Among such particulate resins, particulate resins having a relatively narrow particle diameter distribution and a volume average particle diameter of from 0.01 μm to 1 μm are preferably used as the cleanability improving agent.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

1. Preparation of Colorant Dispersion

The following components were mixed.

| | |
|---|---|
| Carbon black (REGAL 400 from Cabot Corp.) | 17 parts |
| Dispersant (copolymer having a basic functional group, AJISPER PB821 from Ajinomoto Fine-Techno Co., Ltd.) | 3 parts |
| Ethyl acetate | 80 parts |

The mixture was subjected to a primary dispersing treatment using a mixer having a rotor blade. The thus prepared primary dispersion was subjected to a secondary dispersing treatment using a bead mill (LMZ-type bead mill from Ashizawa Finetech Ltd.), which uses zirconia beads with a diameter of 0.3 mm and which can apply a strong shearing force, to prepare a dispersion of the carbon black, which did not include aggregates of the carbon black having a particle diameter of not less than 5 μm. Thus, a colorant dispersion was prepared.

2. Preparation of Wax Dispersion

The following components were mixed.

| | |
|---|---|
| Carnauba wax | 18 parts |
| Dispersant (polyethylene wax on which a styrene-butyl acrylate copolymer is grafted) | 2 parts |
| Ethyl acetate | 80 parts |

The mixture was subjected to a primary dispersing treatment using a mixer having a rotor blade. The primary dispersion was heated to 80° C. to dissolve the carnauba wax, and the solution was cooled to room temperature to precipitate a particulate carnauba wax having a maximum particle diameter of not greater than 3 μm. The thus prepared dispersion was subjected to a secondary dispersing treatment using a bead mill (LMZ-type bead mill from Ashizawa Finetech Ltd.), which uses zirconia beads with a diameter of 0.3 mm and which can apply a strong shearing force, to prepare a dispersion of the carnauba wax having a maximum particle diameter of not greater than 1 μm. Thus, a wax dispersion was prepared.

3. Preparation of Toner Composition Liquid

The following components were mixed for 10 minutes using a mixer having a rotor blade to prepare a toner composition liquid (dispersion).

| | |
|---|---|
| Polyester resin | 100 parts |
| Colorant dispersion prepared above | 30 parts |
| Wax dispersion prepared above | 30 parts |
| Ethyl acetate | 840 parts |

In this regard, when mixing the components, a problem in that the pigment particles and wax particles are shocked by the solvent and aggregate was not caused.

4. Toner Production Apparatus

A toner production apparatus having such a structure as illustrated in FIG. 1 and using a droplet ejector, which is a liquid column resonance type droplet ejector and which has such a structure as illustrated in FIG. 2, was used to eject droplets of the toner composition liquid prepared above.

In this regard, the details of the droplet ejector are as follows.

(1) The length L of the liquid column resonance chamber 22: 1.85 mm (2) Resonance mode: N=2 resonance mode (3) Position of first to fourth nozzles: A position corresponding to the antinode of the pressure standing wave in N=2 resonance mode (4) Diameter of nozzles: 10 μm (5) Nozzle plate: The nozzle plate was subjected to water-repellent treatment, and the contact angle of the nozzle surface against the toner composition liquid was 45.4 degree.

(6) Drive signal generator: Function generator WF1973 from NF Corp. This function generator was connected with the vibrator 25 with a wire covered with polyethylene to vibrate the vibrator.

(7) Drive frequency: 340 kHz (which is equal to the liquid column resonance frequency)

(8) Pressure to nozzles: The pressure was measured with the pressure gauge 19 illustrated in FIG. 1 at a position on the same level as the nozzles. Therefore, the pressure could be precisely measured.

(9) Airflow passage 65: The width and height of the airflow passage were 80 mm and 10 mm, respectively.

(10) Flow speed of airflow 31: 12 m/s

The details of the cleaner are as follows.

(1) Cleaner used: The cleaner illustrated in FIG. 13 was used.

(2) Cleaning liquid vibrator 45: A Langevin type ultrasonic vibrator having a vibration surface of 40 mm×40 mm and having a resonance frequency of 40 kHz was used. A power of 40 kHz and 100 Vp-p was applied to the vibrator by an AC power source.

(3) Cleaning liquid feed pipe 43: A pipe having a diameter of 3 min was used, and a cleaning liquid was supplied or discharged through the pipe at a flow rate of 300 ml/m by the pump 42, which is a gear pump.

(4) Shutter 41: A slidable shutter was used. A packing was provided between the shutter and the wall of the chamber 62 to prevent the cleaning liquid from leaking.

(5) Airflow passage 65: The inner surface of the airflow passage 65 was subjected to the liquid repelling treatment mentioned above, wherein the contact angle of the inner surface against the toner composition liquid was 45.4 degree.

The details of the toner collector 60 are as follows.

(1) Chamber 62: A cylindrical chamber which has an inner diameter of 400 mm and a height of 2,000 mm and which is set vertically was used, wherein each of the upper end (i.e., entrance of airflow) and the lower end (i.e., exit of airflow) of the chamber is narrowed to have an inner diameter of 50 mm.

(2) Position of droplet ejector 20: The droplet ejector was provided at a center of the chamber, which is 30 mm apart from the upper end of the chamber 62.

(3) Airflow 31: A nitrogen gas having a temperature of 40° C. and a flow speed of 0.56 m/s was used as the airflow 31.

The details of the cleaning process are as follows.

(1) Cleaning method: The cleaning operation was performed on the droplet ejector 20 at regular intervals of 20 minutes. In the cleaning operation, initially ejection of the toner composition liquid from the droplet ejector 20 was stopped, and then the shutter 41 was slid (closed) to form a cleaning space in the airflow passage 65. Next, the cleaning liquid (ethyl acetate) 44 was supplied to the cleaning space in an amount of 64 ml at a flow speed of 300 ml/min using the gear pump 42. In addition, the liquid supplied to the droplet ejector 20 was switched from the toner composition liquid 12 to the second cleaning liquid (ethyl acetate) 52 by the switching device 17 and the valve 57 was opened. Next, 100 ml of the cleaning liquid 52 was supplied to the droplet ejector 20 by the cleaning liquid supplying device 56, which is a gear pump, to discharge the toner composition liquid from the droplet ejector 20 (i.e., to replace the toner composition liquid in the droplet ejector 20 with the cleaning liquid 52). After the valve 57 was closed, the cleaning liquid 52 was supplied by the cleaning liquid supplying device 56 at a pressure of +40 kPa, which was measured with the pressure gauge 19. After performing this pressure cleaning for 30 seconds, the cleaning liquid supplying device 56 was stopped. At the same time as the pressure cleaning, a power of 20 kHz and 100 Vp-p was applied to the Langevin type vibrator 45 for 60 seconds. In this cleaning operation, a voltage of 6.0V having a frequency of 340 kHz was also applied to the vibrator 25 of the droplet ejector 20. After stopping the pressure cleaning while stopping energization of the cleaning liquid vibrator 45, the cleaning liquid 44 was discharged by the pump 42 at a flow speed of 300 ml/min, and then the shutter 41 was opened (i.e., returned to the home position). Thus, the cleaning operation was completed.

The above-prepared toner composition liquid was ejected as droplets by the toner production apparatus mentioned above. The droplets were dried in the chamber 62 to form toner particles, and the toner particles were collected by a cyclone-type toner collector 63 and contained in the toner container 64. Thus, a toner of Example 1 was prepared. The volume average particle diameter (Dv) and number average particle diameter (Dn) of the toner of Example 1 were measured three times with a flow particle image analyzer FPIA-3000 from Sysmex Corp. As a result, the volume average particle diameter (Dv) and number average particle diameter (Dn) of the toner of Example 1 were 5.6 μm and 5.2 μm respectively. ID this case, the average particle diameter ratio (Dv/Dn) was 1.08.

The particle diameter measuring method was as follows.

(1) A few drops of a nonionic surfactant (CONTAMIN N from Wako Pure Chemical Industries, Ltd.) was added to 10 ml of water, which had been subjected to a filtering treatment to remove foreign particles to an extent such that the number of particles having a circle-equivalent diameter in a measurement range of from 0.60 μm to 159.21 μm is not greater than 20 in a unit volume of $10^{-3}$ $cm^3$;

(2) Five (5) milligrams of a sample (toner) was added thereto, and the mixture was subjected to a dispersing treatment for 1 minute using a supersonic dispersing machine UH-50 from STM Co., Ltd. under conditions of 20 kHz in frequency and 50 W/10 $cm^3$ in power. This dispersing treatment was performed 5 times to prepare a sample dispersion in which toner particles of from 4,000 to 8,000 are present in a unit volume of 1 $cm^3$. The particle diameter distribution of the toner particles in the sample dispersion in a range of from 0.60 μm to 159.21 μm was measured with the flow particle image analyzer.

The sample dispersion was passed through a transparent flat and thin flow cell of the analyzer having a thickness of about 200 μm. In the analyzer, a flash lamp is provided in the vicinity of the flow cell to emit light at intervals of 1/30 seconds so as to pass through the flow cell in the thickness direction thereof, and a CCD camera is provided on the opposite side of the flash lamp with the flow cell therebetween to catch the toner particles passing through the flow cell as two-dimensional images. The circle-equivalent particle diameter of each toner particle (i.e., the particle diameter of a circle having the same area as a toner particle) was determined from the two-dimensional images taken by the CCD camera.

The analyzer could measure the circle-equivalent particle diameters of more than 1200 particles in 1 minute, and the number-basis percentage of each of particle diameter channels of the toner particles could be determined. In this regard, the particle diameter range of from 0.06 μm to 400 μm is divided into 226 channels (i.e., 30 channels for 1 octave). In this measurement, the particle diameter range is from 0.06 μm to 159.21 μm. Thus, the number-basis percentage of each of particle diameter channels of the toner particles, and accumulated percentage could be determined.

In this toner preparation operation including the cleaning operation, the following evaluations were performed.

(1) Condition of Nozzles after Cleaning Operation

After the cleaning operation, the nozzles were photographed and the photograph was visually observed to determine the number of nozzles on which smudge (deposit) still remains. The nozzle condition evaluation was performed as follows.

◎: Percentage of nozzles having a smudge is 0%. (Excellent)

○: Percentage of nozzles having a smudge is greater than 0% and not greater than 5%. (Good)

Δ: Percentage of nozzles having a smudge is greater than 5% and not greater than 10%. (Acceptable)

X: Percentage of nozzles having a smudge is greater than 10%. (Bad)

(2) Ejection Recovery Rate

In the droplet ejection operation, the nozzles were photographed and the photograph was visually observed to determine the number of nozzles from which droplets are ejected normally. The ejection recovery rate is graded as follows.

◎: Percentage of effective nozzles is from 98% to 100%. (Excellent)

○: Percentage of effective nozzles is from 95% to 97%. (Good)

Δ: Percentage of effective nozzles is from 90% to 94%. (Acceptable)

X: Percentage of effective nozzles is less than 89%. (Bad)

(3) Average Particle Diameter Ratio (Dv/Dn)

The volume average particle diameter (Dv) and the number average particle diameter (Dn) of the toner were measured three times by the method mentioned above to determine the average particle diameter ratio (Dv/Dn). The average particle diameter ratio was graded as follows.

◎: The average particle diameter ratio is from 1.00 to 1.07. (Excellent)

○: The average particle diameter ratio is from 1.08 to 1.12. (Good)

Δ: The average particle diameter ratio is from 1.13 to 1.18. (Acceptable)

X: The average particle diameter ratio is not less than 1.19. (Bad)

(4) Overall Evaluation of Cleaning Operation

Overall evaluation of the cleaning operation was performed based on the evaluation results mentioned above in paragraphs (1) to (3). The overall evaluation result is the same as the worst evaluation result among the evaluation results of from (1) to (3).

Examples 2 to 12

The procedure for preparation of the toner of Example 1 was repeated except that the cleaning conditions were changed as described in Table 1 below. In addition, the procedure for evaluation in Example 1 was repeated. The evaluation results are shown in Table 1.

Specifically, in Examples 2 to 4, the pressure cleaning operation time was changed.

In Example 5, vibration of the vibrator 25 of the droplet ejecting head was not performed.

In Examples 6 to 8, the cleaning liquid was changed from ethyl acetate to acetone (Example 6), methyl ethyl ketone (MEK) (Example 7), or tetrahydrofuran (THF) (Example 8).

In Example 11, a suction cleaning operation was performed instead of the pressure cleaning operation.

Specifically, the cleaning operation was performed on the droplet ejector 20 at regular intervals of 20 minutes. In the cleaning operation, initially ejection of the toner composition liquid from the droplet ejector 20 was stopped, and then the shutter 41 was slid (closed) to form a cleaning space. Next, the first cleaning liquid (ethyl acetate) 44 was supplied to the cleaning space in an amount of 64 ml at a flow speed of 300 ml/min using the gear pump 42. In addition, the liquid supplied to the droplet ejector 20 was switched from the toner composition liquid 12 to the second cleaning liquid (ethyl acetate) 52 by the switching device 17, and the valve 57 was opened. Next, 100 ml of the second cleaning liquid 52 was supplied to the droplet ejector 20 by the second cleaning liquid supplying device 56, which is a gear pump, to discharge the toner composition liquid from the droplet ejector 20 (i.e., to replace the toner composition liquid in the droplet ejector 20 with the second cleaning liquid 52). After the second cleaning liquid supplying device 56 was stopped, the second cleaning liquid was sucked by the discharging device 59 so that the pressure measured by the pressure gauge 19 was −20 kPa. After the sucking operation was performed for 60 seconds, the discharging device 59 was stopped. At the same time as the sucking operation, a power of 20 kHz and 100 Vp-p was applied to the Langevin type vibrator 45 for 60 seconds. In this cleaning operation, a voltage of 6.0V having a frequency of 340 kHz was also applied to the vibrator 25 of the droplet ejector 20. After stopping the suction cleaning while stopping energization of the cleaning liquid vibrator 45, the first cleaning liquid 44 was discharged by the pump 42, and then the shutter 41 was opened (i.e., returned to the home position). Thus, the cleaning operation was completed.

In Example 12, the procedure for preparation of the toner of Example 1 was repeated except that a combination of the pressure cleaning operation performed in Example 1, a suction cleaning operation (suction pressure of −20 kPa), and the pressure cleaning operation was used instead of only the pressure cleaning operation.

Specifically, the cleaning operation was performed on the droplet ejector 20 at regular intervals of 20 minutes. In the cleaning operation, initially ejection of the toner composition liquid from the droplet ejector 20 was stopped, and then the shutter 41 was slid (closed) to form a cleaning space. Next, the first cleaning liquid (ethyl acetate) 44 was supplied to the cleaning space in an amount of 64 ml at a flow speed of 300 ml/min using the gear pump 42. In addition, the liquid supplied to the droplet elector 20 was switched from the toner composition liquid 12 to the second cleaning liquid (ethyl acetate) 52 by the switching device 17, and the valve 57 was opened. Next, 100 ml of the second cleaning liquid 52 was supplied to the droplet ejector 20 by the second cleaning liquid supplying device 56, which is a gear pump, to discharge the toner composition liquid from the droplet ejector 20 (i.e., to replace the toner composition liquid in the droplet ejector 20 with the second cleaning liquid 52). After the valve 57 was closed, the second cleaning liquid 52 was supplied by the second cleaning liquid supplying device 56 at a pressure of +40 kPa, which was measured with the pressure gauge 19. After performing this pressure cleaning for 30 seconds, the second cleaning liquid supplying device 56 was stopped. At the same time as the pressure cleaning operation, a power of 20 kHz and 100 Vp-p was applied to the Langevin type vibrator 45 for 30 seconds. In this pressure cleaning operation, a voltage of 6.0V having a frequency of 340 kHz was also applied to the vibrator 25 of the droplet ejector 20. Since the cleaning liquid in the cleaning space was cloudy due to dissolving and mixing of smudges, the first cleaning liquid 44 was discharged by the pump 42 at a flow speed of 300 ml/min, and then a pure cleaning liquid 44 (ethyl acetate) in an amount of 64 ml was supplied to the cleaning space so that part of the airflow passage 65 was filled with the first cleaning liquid.

Next, the discharging device 59 was operated to suck the second cleaning liquid at a pressure of −20 kPa measured with the pressure gauge 19. Thus, this suction cleaning operation was performed for 30 seconds. At the same time as the suction cleaning operation, a power of 20 kHz and 100 Vp-p was applied to the Langevin type vibrator 45 for 30 seconds.

Thereafter, a second pressure cleaning operation was performed. Specifically, after the valve 57 was closed, the second cleaning liquid 52 was supplied by the second cleaning liquid supplying device 56 at a pressure of +40 kPa, which was measured with the pressure gauge 19. After performing this pressure cleaning operation for 30 seconds, the second cleaning liquid supplying device 56 was stopped. At the same time as the pressure cleaning operation, a power of 20 kHz and 100 Vp-p was applied to the Langevin type vibrator 45 for 30 seconds. In this pressure cleaning operation, a voltage of 6.0V having a frequency of 340 kHz was also applied to the vibrator 25 of the droplet ejector 20. After the first pressure cleaning operation, the suction cleaning operation and the second pressure cleaning operation were completed, the first cleaning liquid 44 was discharged from the cleaning space, and the shutter 41 was opened, resulting in completion of the cleaning operation.

TABLE 1

| | Cleaning liquid | Temp. of cleaning liquid (° C.) | Cleaning method and time (sec) | Vibration of vibrator 25 of ejecting head | Condition of nozzles | Ejection recovery rate: | Dv/Dn | Overall evaluation of cleaning operation |
|---|---|---|---|---|---|---|---|---|
| Ex. 1 | Ethyl acetate | 40 | Pressure cleaning (30) | Yes | Δ | Δ | ○ | Δ |

TABLE 1-continued

| | Cleaning liquid | Temp. of cleaning liquid (° C.) | Cleaning method and time (sec) | Vibration of vibrator 25 of ejecting head | Condition of nozzles | Ejection recovery rate: | Dv/Dn | Overall evaluation of cleaning operation |
|---|---|---|---|---|---|---|---|---|
| Ex. 2 | Ethyl acetate | 40 | Pressure cleaning (60) | Yes | ○ | Δ | ○ | Δ |
| Ex. 3 | Ethyl acetate | 40 | Pressure cleaning (180) | Yes | ○ | ○ | ◎ | ○ |
| Ex. 4 | Ethyl acetate | 40 | Pressure cleaning (300) | Yes | ◎ | ◎ | ◎ | ◎ |
| Ex. 5 | Ethyl acetate | 40 | Pressure cleaning (300) | No | ○ | ○ | ◎ | ○ |
| Ex. 6 | Acetone | 40 | Pressure cleaning (180) | Yes | ◎ | ○ | Δ | Δ |
| Ex. 7 | Methyl ethyl ketone | 40 | Pressure cleaning (180) | Yes | ◎ | ◎ | ○ | ○ |
| Ex. 8 | Tetra-hydro-furan (THF) | 40 | Pressure cleaning (180) | Yes | ◎ | ◎ | ◎ | ◎ |
| Ex. 9 | Ethyl acetate | 20 | Pressure cleaning (180) | Yes | ○ | Δ | ○ | Δ |
| Ex. 10 | Ethyl acetate | 60 | Pressure cleaning (180) | Yes | ◎ | ◎ | ◎ | ◎ |
| Ex. 11 | Ethyl acetate | 40 | Suction cleaning (60) | Yes | ○ | Δ | ○ | Δ |
| Ex. 12 | Ethyl acetate | 40 | Pressure (30) → suction (30) → pressure (30) | Yes | ◎ | ◎ | ◎ | ◎ |

It is clear from Table 1 that the droplet ejector can be satisfactorily cleaned by the cleaning method of this disclosure, particularly by the cleaning method of Examples 4, 8, 10 and 12.

Effect of this Disclosure

As described above, in this cleaning method a sufficient amount of cleaning liquid is contacted with smudges (such as deposit) on the nozzles and the nozzle plate, which are formed by the particulate material composition liquid (such as toner composition liquid) ejected from the nozzles, to dissolve the smudges or release the smudges from the nozzles and the nozzle plate. In addition, by vibrating the cleaning liquid, the smudges can be satisfactorily removed from the nozzles and the nozzle plate even when the smudges are dried. Therefore, cleaning the nozzles and the nozzle plate can be performed in a short time by the cleaning method of this disclosure.

Each of the cleaning Method and the cleaner mentioned above is an example, and this disclosure includes the following embodiments, which produce the following effects.

Embodiment 1

In a cleaning method for removing smudges of a particulate material composition liquid (such as toner composition liquid) adhered to nozzles, from which the particulate material composition liquid is ejected as droplets, and a nozzle plate bearing the nozzles, a cleaning liquid is contacted with the smudges while vibrating the cleaning liquid to clean the nozzles and the nozzle plate. As mentioned above, by using this method, a sufficient amount of cleaning liquid is supplied so that the cleaning liquid is contacted with the smudges, and the smudges can be dissolved in the cleaning liquid. Even when the smudges are a solidified particulate material composition liquid, the smudges can be removed from the nozzles and nozzle plate by vibrating the cleaning liquid. Therefore, the nozzles and the nozzle plate can be satisfactorily cleaned in a short time.

Embodiment 2

In the cleaning method of Embodiment 1, the particulate material composition liquid in the droplet ejector is replaced with the cleaning liquid before starling the cleaning operation. By using this method, the cleaning liquid can be supplied to the smudges on the nozzles and nozzle plate more satisfactorily. Therefore, the smudges can be dissolved by the cleaning liquid more satisfactorily, and the nozzles and the nozzle plate can be satisfactorily cleaned in a shorter time.

Embodiment 3

In the cleaning Method of Embodiment 1 or 2, the cleaning liquid supplied to the droplet ejector 20 is pressed to perform pressure-cleaning. By using this method, the cleaning liquid can be supplied to the smudges on the nozzles and nozzle plate more satisfactorily. Therefore, the smudges can be dissolved by the cleaning liquid more satisfactorily, and the nozzles and the nozzle plate can be satisfactorily cleaned in a shorter time.

Embodiment 4

In the cleaning method of Embodiment 1 or 2, the cleaning operation is performed by sucking the cleaning liquid supplied to the droplet ejector 20 while sucking the cleaning liquid outside the droplet ejector through the nozzles. By using this method, the cleaning liquid can be supplied to the smudges in the vicinity of the nozzles. Therefore, the smudges can be dissolved by the cleaning liquid more satisfactorily, and the nozzles and the nozzle plate can be satisfactorily cleaned in a shorter time.

Embodiment 5

In the cleaning method of Embodiment 1 or 2, a pressure cleaning operation in which the cleaning liquid is supplied toward the droplet ejector 20 while pressing the cleaning liquid and the cleaning liquid is discharged to outside is performed, and then a suction cleaning operation in which the cleaning liquid supplied to the droplet ejector is sucked while the cleaning liquid outside the droplet ejector is sucked through the nozzles is performed, followed by the pressure cleaning operation. By using this method, the cleaning liquid can be supplied to the smudges on the nozzles and nozzle plate in a more sufficient amount. Therefore, the smudges can be dissolved by the cleaning liquid more satisfactorily, and the nozzles and the nozzle plate can be satisfactorily cleaned in a shorter time.

Embodiment 6

In the cleaning method of any one of Embodiments 1 to 5, the vibrator in the droplet ejector is vibrated. By using this method, the smudges can be dissolved or released from the nozzles and nozzle plate even when the smudges are solidified particulate material composition liquid. Therefore, the nozzles and the nozzle plate can be satisfactorily cleaned in a shorter time.

Embodiment 7

In the cleaning method of any one of Embodiments 1 to 6, the cleaning liquid is the same kind of solvent as used for the particulate material composition liquid. By using this method, the smudges can be satisfactorily dissolved by the cleaning liquid, and therefore the nozzles and the nozzle plate can be satisfactorily cleaned in a shorter time.

Embodiment 8

In the cleaning method of any one of Embodiments 1 to 6, the cleaning liquid is a solvent capable of dissolving the smudges (i.e., solid particulate material composition). By using this method, the smudges can be satisfactorily dissolved by the cleaning liquid, and therefore the nozzles and the nozzle plate can be satisfactorily cleaned in a shorter time.

Embodiment 9

In the cleaning method of any one of Embodiments 1 to 8, the temperature of the cleaning liquid is not lower than the temperature of the particulate material composition liquid. By using this method, the smudges can be satisfactorily dissolved by the cleaning liquid, and therefore the nozzles and the nozzle plate can be satisfactorily cleaned in a shorter time.

Embodiment 10

In a cleaner to remove smudges of a particulate material composition liquid adhered to nozzles, from which the particulate material composition liquid (such as toner composition liquid) is ejected as droplets, and a nozzle plate bearing the nozzles, the cleaner includes a cleaning space forming device to form a substantially closed space around the nozzles and the nozzle surface; a cleaning liquid supplying device to supply a cleaning liquid to the cleaning space; and a vibrator to vibrate the cleaning liquid so that the nozzles and the nozzle plate are contacted with the vibrated cleaning liquid. By supplying the cleaning liquid to the cleaning space while vibrating the cleaning liquid, the nozzles and the nozzle plate are cleaned. By using this cleaner, a sufficient amount of cleaning liquid can be supplied so that the cleaning liquid is contacted with the smudges, and therefore the smudges can be dissolved in the cleaning liquid. Even when the smudges are solidified particulate material composition liquid, the smudges can be removed from the nozzles and nozzle plate by vibrating the cleaning liquid. Therefore, the nozzles and the nozzle plate can be satisfactorily cleaned in a short time.

Embodiment 11

In the cleaner of Embodiment 10, the vibrator is provided on a wall forming the cleaning space so as to face the droplet ejector. By using this cleaner, vibration can be securely transmitted to the smudges on the nozzles and the nozzle plate, and therefore the smudges can be easily released from the nozzles and the nozzle plate.

Embodiment 12

In the cleaner of Embodiment 10 or 11, the cleaner further includes a second cleaning liquid supplying device to supply a second cleaning liquid, which is the same as or different from the cleaning liquid mentioned above, to the droplet ejector; a switching device to switch the particulate material composition liquid, which is supplied to the droplet ejector by a particulate material composition liquid supplying device, to the second cleaning liquid, which is supplied by the second cleaning liquid supplying device, or vice versa; and a discharging device to discharge the liquid in the droplet ejector to outside. Therefore the particulate material composition liquid in the droplet ejector is discharged from the droplet ejector and replaced with the second cleaning liquid without drying the droplet ejector and the liquid flow passage. In addition, smudges and bubbles in the droplet ejector 20 (such as smudges and bubbles in the chamber 22) can be discharged to outside. Therefore, the nozzles and the nozzle plate can be satisfactorily cleaned in a short time.

Embodiment 13

A particulate material production apparatus is provided which includes the cleaner of any one of Embodiments 10 to 12, a droplet ejector to eject a particulate material composition liquid (such as toner composition liquid) from nozzles as droplets, and a solidifying device to solidify the droplets to form a particulate material. By using this particulate material production apparatus, a sufficient amount of cleaning liquid can be supplied so that the cleaning liquid is contacted with the smudges, and therefore the smudges can be dissolved in the cleaning liquid. Even when the smudges are solidified particulate material composition liquid, the smudges can be removed from the nozzles and nozzle plate by vibrating the Gleaning liquid. Therefore, the nozzles and the nozzle plate can be satisfactorily cleaned in a short time, and the particulate material can be produced with high efficiency.

Embodiment 14

In the particulate material production apparatus of Embodiment 13, the pressure of the particulate material composition liquid in the chamber of the droplet ejector is changed when the vibrator vibrates the cleaning liquid. By using this particulate material production apparatus, droplets can be stably ejected even after the cleaning operation.

Embodiment 15

In the particulate material production apparatus of Embodiment 14, the pressure of the particulate material composition liquid in the chamber of the droplet ejector is substantially equal to the pressure of the cleaning liquid in the vicinity of the nozzles in the cleaning space. By using this particulate material production apparatus, the dissolved smudges are prevented from entering into the droplet ejector through the nozzles while preventing the cleaning liquid from entering into the droplet ejector (i.e., preventing the particulate material composition liquid in the droplet ejector from being diluted or degrading.

Embodiment 16

In the particulate material production apparatus of Embodiment 14, difference between the pressure of the particulate material composition liquid in the chamber of the droplet ejector and the pressure of the cleaning liquid in the vicinity of the nozzles is from −50 to +50 kPa. By using this particulate material production apparatus, occurrence of problems in that droplet ejector is damaged due to excessively high liquid pressure, and bubbles are formed in the chamber of the droplet ejector due to cavitation caused by reduction of pressure can be prevented.

Embodiment 17

In the particulate material production apparatus of any one of Embodiments 13 to 16, the nozzle plate bearing the nozzles and the inner surface of an airflow passage of the solidifying device, in which the cleaning space is formed, has a $SiO_2$ layer on the surface thereof, and a liquid repelling layer which repels the particulate material composition liquid and which is located on the $SiO_2$ layer. By using this particulate material production apparatus, the particulate material productivity can be enhanced, and the cleaning effect can be enhanced.

Embodiment 18

In the particulate material production apparatus of Embodiment 17, the liquid repelling layer includes a material including a perfluoroalkyl group, and a siloxane-bonded alkyl group at the end thereof. By using this particulate material production apparatus, the particulate material productivity can be enhanced, and the cleaning effect can be enhanced.

Embodiment 19

In the particulate material production apparatus of any one of Embodiments 13 to 18, the particulate material composition liquid is a toner composition liquid including a resin. By using this particulate material production apparatus, a toner can be produced with high productivity, and the cleaning effect can be enhanced.

Additional modifications and variations of the present invention are possible in light of the above teachings. It is therefore to be understood that within the scope of the appended claims the invention may be practiced other than as specifically described herein.

What is claimed is:

1. A particulate material production apparatus comprising:

a droplet ejector to eject droplets of a particulate material composition liquid in a chamber from nozzles, wherein the chamber has nozzles and a nozzle plate bearing the nozzles;

a solidifying device to solidify the ejected droplets to form a particulate material; and a cleaner to clean the nozzles and the nozzle plate, the cleaner comprising:

a cleaning space forming device to form a substantially closed cleaning space outside the nozzles and the nozzle plate;

a first cleaning liquid supplying device to supply a first cleaning liquid to the cleaning space so that the nozzles and the nozzle plate are contacted with the first cleaning liquid; and a vibrator to vibrate the first cleaning liquid when the nozzles and the nozzle plate are contacted with the first cleaning liquid to clean the nozzles and the nozzle plate.

2. The particulate material production apparatus according to claim 1, wherein a pressure to the particulate material composition liquid in the chamber of the droplet ejector is substantially equal to a pressure to the first cleaning liquid in a vicinity of the nozzles after the first cleaning liquid is supplied to the cleaning space.

3. The particulate material production apparatus according to claim 1, wherein the cleaner further includes:

a particulate material composition liquid supplying device to supply the particulate material composition liquid to the droplet ejector;

a second cleaning liquid supplying device to supply a second cleaning liquid, which is the same as or different from the first cleaning liquid, to the droplet ejector;

a switching device to switch between the particulate material composition liquid and the second cleaning liquid so that one of the particulate material composition liquid and the second cleaning liquid is supplied to the droplet ejector; and a discharging device to discharge at least one of the particulate material composition liquid and the second cleaning liquid in the droplet ejector to outside, wherein when the vibrator of the cleaner vibrates the first cleaning liquid, the second cleaning liquid supplying device applies a pressure to the second cleaning liquid in the chamber while changing the pressure.

4. The particulate material production apparatus according to claim 3, wherein a difference between the pressure to the second cleaning liquid in the chamber and a pressure to the first cleaning liquid in a vicinity of the nozzles after the first cleaning liquid is supplied to the cleaning space is from −50 to +50 kPa.

5. The particulate material production apparatus according to claim 1, wherein the nozzle plate bearing the nozzles has a $SiO_2$ layer on a surface thereof, and a liquid repelling layer which repels at least the particulate material composition liquid and which is located on the $SiO_2$ layer, and wherein an inner surface of a portion of the solidifying device forming the cleaning space has the SiO2 layer and the liquid repelling layer.

6. The particulate material production apparatus according to claim 5, wherein the liquid repelling layer includes a material having a perfluoroalkyl group, and a siloxane-bond including alkyl group at an end thereof.

7. The particulate material production apparatus according to claim 1, wherein the particulate material composition liquid is a toner composition liquid including a resin, and the particulate material is a toner including the resin.

* * * * *